US011111059B2

(12) United States Patent
Fleming

(10) Patent No.: US 11,111,059 B2
(45) Date of Patent: Sep. 7, 2021

(54) DRINK-THROUGH RECLOSABLE SPILL RESISTANT BEVERAGE CUP LID WITH VENT STRUCTURE

(71) Applicant: VAPORPATH, INC., Bainbridge Island, WA (US)

(72) Inventor: Douglas H Fleming, Bainbridge Island, WA (US)

( * ) Notice: Subject to any disclaimer, the term of this patent is extended or adjusted under 35 U.S.C. 154(b) by 177 days.

(21) Appl. No.: 16/040,044

(22) Filed: Jul. 19, 2018

(65) Prior Publication Data

US 2019/0023459 A1 Jan. 24, 2019

Related U.S. Application Data

(60) Provisional application No. 62/652,294, filed on Apr. 3, 2018, provisional application No. 62/535,786, filed on Jul. 21, 2017.

(51) Int. Cl.

| | |
|---|---|
| ***B65D 43/02*** | (2006.01) |
| ***B65D 47/20*** | (2006.01) |
| *B65D 47/32* | (2006.01) |

(52) U.S. Cl.

CPC ..... *B65D 43/0212* (2013.01); *B65D 47/2025* (2013.01); *B65D 47/32* (2013.01);
(Continued)

(58) Field of Classification Search

CPC ..... B65D 2543/00046; B65D 47/2018; B65D 47/2025; B65D 47/36; B65D 43/0218; B65D 43/0212

See application file for complete search history.

(56) References Cited

U.S. PATENT DOCUMENTS

| | | | |
|---|---|---|---|
| 2,358,600 | A | 9/1944 | Selten |
| 2,362,354 | A | 11/1944 | Clovis |

(Continued)

FOREIGN PATENT DOCUMENTS

| | | |
|---|---|---|
| CA | 2245369 | 3/2000 |
| CA | 2212228 | 7/2002 |

(Continued)

OTHER PUBLICATIONS

US 6,003,721 A, 12/1999, Fleming (withdrawn)

(Continued)

*Primary Examiner* — Mollie Impink

(74) *Attorney, Agent, or Firm* — R. Reams Goodloe, Jr.

(57) ABSTRACT

A drink-through lid for a beverage container. The lid provides a drink outlet that allows liquid to fill a drink well base, from which a consumer may sip a beverage similar to using an open top cup or mug. The lid is provided with a flexible structure which may be reversibly positionable between a drink outlet closed position and a drink outlet open position. In an embodiment, an outer or distal end of the flexible structure may be moved to a spill resistant position, wherein the outer end of the flexible structure substantially prevents splash of liquid outward from the beverage container thought the drink outlet, even when the flexible structure is in the open position. The flexible structure may include multiple panels and hinges which allow downward and upward movement by manual manipulation, to enable a user to open and close the drink outlet.

28 Claims, 24 Drawing Sheets

(52) U.S. Cl.
CPC ..... *B65D 2543/00046* (2013.01); *B65D 2543/00092* (2013.01); *B65D 2543/00296* (2013.01); *B65D 2543/00351* (2013.01); *B65D 2543/00537* (2013.01); *B65D 2543/00638* (2013.01); *B65D 2543/00685* (2013.01); *B65D 2543/00731* (2013.01); *B65D 2543/00796* (2013.01)

(56) References Cited

U.S. PATENT DOCUMENTS 3,227,304 A * 1/1966 Ashury ..... B65D 17/401 220/268
3,360,161 A 12/1967 Smith
3,400,855 A 9/1968 Alexander
3,860,162 A * 1/1975 Schutz ..... B65D 47/2018 220/711
3,868,043 A 2/1975 Freemyer
3,938,695 A 2/1976 Ruff
3,977,559 A 8/1976 Lombardi
3,994,411 A 11/1976 Elfelt et al.
4,081,103 A * 3/1978 Zoellick ..... B65D 47/2018 220/254.3
4,085,861 A 4/1978 Ruff
4,090,660 A 5/1978 Schram et al.
4,113,135 A * 9/1978 Yamazaki ..... B65D 17/401 220/268
4,184,604 A * 1/1980 Amberg ..... B65D 47/2018 220/254.3
4,190,174 A * 2/1980 Haimowitz ..... B65D 47/2018 220/254.3
4,210,256 A * 7/1980 Amberg ..... B65D 47/2018 220/254.3
4,245,752 A * 1/1981 Prueher ..... B65D 47/2018 215/311
4,345,695 A * 8/1982 Galloway ..... B65D 47/2018 220/254.3
4,350,260 A * 9/1982 Prueher ..... B65D 47/2018 220/254.3
4,361,249 A 11/1982 Tuneski
4,412,629 A * 11/1983 Dart ..... B65D 21/0219 220/254.1
4,502,608 A 3/1985 Mills
4,503,992 A 3/1985 Sitko
4,582,214 A * 4/1986 Dart ..... B65D 21/0219 206/508
4,586,625 A 5/1986 Garrett
4,589,569 A 5/1986 Clements
4,609,124 A 9/1986 Malloy
4,619,372 A 10/1986 McFarland
D287,919 S 1/1987 Clements
4,723,684 A * 2/1988 Lambert ..... B65D 17/401 220/268
4,768,674 A 9/1988 Prescott
D299,010 S 12/1988 Wall
4,938,377 A 7/1990 Jarvis
4,949,865 A 8/1990 Turner
4,986,437 A 1/1991 Farmer
5,111,961 A 5/1992 Van Melle
5,183,172 A 2/1993 Boller
D342,097 S 12/1993 Seaman
D345,673 S 4/1994 Dark
5,370,258 A 12/1994 Fair
5,398,843 A * 3/1995 Warden ..... B65D 43/0212 220/254.1
5,540,350 A 7/1996 Lansky
5,542,670 A 8/1996 Morano
D377,313 S 1/1997 Tipp
D377,810 S 2/1997 Chaperon
5,699,927 A 12/1997 Lane et al.
5,820,016 A 10/1998 Stropkay
5,894,952 A 4/1999 Mendenhall et al.
5,897,019 A 4/1999 Stropkay
D416,755 S 11/1999 Trombly
5,988,426 A 11/1999 Stern
6,003,711 A 12/1999 Bilewitz
6,079,586 A 6/2000 Hanneman
6,176,420 B1 1/2001 Sarson
6,196,411 B1 3/2001 Nava et al.
6,311,863 B1 11/2001 Fleming
6,325,236 B1 12/2001 Wong
6,375,033 B1 4/2002 Fleming
D456,713 S 5/2002 Bried et al.
D458,844 S 6/2002 Shea
6,419,105 B1 * 7/2002 Bruce ..... B65D 47/06 220/266
6,419,112 B1 7/2002 Bruce et al.
6,431,390 B1 8/2002 Waller
6,488,170 B1 * 12/2002 Johnson ..... B65D 47/06 220/254.2
6,488,173 B2 12/2002 Milan
6,571,973 B1 6/2003 Tripsianes
6,612,456 B1 * 9/2003 Hundley ..... B65D 43/0212 220/254.1
D480,754 S 10/2003 Berger
6,644,490 B2 11/2003 Clarke
D485,758 S 1/2004 Clarke et al.
6,752,287 B1 6/2004 Lin
6,886,707 B2 5/2005 Giraud
6,889,859 B1 5/2005 Leon
6,905,044 B1 6/2005 Russo et al.
D510,266 S 10/2005 Walsh et al.
7,100,790 B2 9/2006 Dark
7,185,781 B2 3/2007 Pitts
D539,649 S 4/2007 Smith et al.
D539,650 S 4/2007 Smith et al.
D540,165 S 4/2007 Hollis et al.
D546,180 S 7/2007 Jowett et al.
D547,605 S 7/2007 Edelstein et al.
7,246,716 B2 7/2007 Durdon
7,275,652 B2 10/2007 Morris et al.
D566,552 S 4/2008 Vette
7,353,582 B2 4/2008 Mackenzie et al.
7,484,638 B2 2/2009 Mazzarolo
D592,056 S 5/2009 Tedford, Jr.
D592,952 S 5/2009 Hundley et al.
7,556,172 B2 7/2009 Lane
7,591,393 B2 9/2009 Crudgington, Jr.
D622,995 S 9/2010 Beraha
D627,827 S 11/2010 Rogers
D632,174 S 2/2011 Charbonnet et al.
D634,192 S 3/2011 Mueller
D635,855 S 4/2011 Smith et al.
D637,079 S 5/2011 Brown et al.
7,959,029 B2 6/2011 Whitaker et al.
D641,242 S 7/2011 Pfarrhofer
D643,245 S 8/2011 Minarsch
D652,300 S 1/2012 Anderson et al.
D655,161 S 3/2012 Daniel
D655,162 S 3/2012 Daniel
D656,023 S 3/2012 Baker et al.
D660,718 S 5/2012 McDermott et al.
D675,524 S 2/2013 Bickert et al.
D679,753 S 4/2013 Sato et al.
D681,453 S 5/2013 Glass et al.
D690,988 S 10/2013 Audette
D691,847 S 10/2013 Beckman
D692,756 S 11/2013 McClellan et al.
8,602,252 B2 * 12/2013 Syrkos ..... B65D 47/2025 220/711
8,616,405 B2 12/2013 French et al.
D704,054 S 5/2014 Fleming
D704,055 S 5/2014 Fleming
8,733,583 B2 5/2014 Bailey
D708,515 S 7/2014 Fleming
D709,366 S 7/2014 Fleming
D709,367 S 7/2014 Fleming
D711,226 S 8/2014 Fleming
D713,685 S 9/2014 Eyal
D721,271 S 1/2015 Fabiszewski
D721,540 S 1/2015 Grcic
D722,498 S 2/2015 Fleming
8,950,623 B2 2/2015 Fleming

(56) References Cited

U.S. PATENT DOCUMENTS

| | | | |
|---|---|---|---|
| 9,061,796 | B2 | 6/2015 | Caldwell |
| D751,396 | S | 3/2016 | Fleming |
| 9,642,483 | B2 | 5/2017 | Fleming |
| 9,751,665 | B2 | 9/2017 | Fleming |
| 9,751,666 | B2 | 9/2017 | Brannock |
| D807,746 | S | 1/2018 | Fleming |
| 2002/0038803 | A1 | 4/2002 | Malcolm |
| 2002/0096530 | A1 | 7/2002 | Waller |
| 2003/0089714 | A1 | 5/2003 | Dart et al. |
| 2003/0218017 | A1 | 11/2003 | Schmidtner et al. |
| 2005/0087539 | A1 | 4/2005 | Waller |
| 2005/0205588 | A1 | 9/2005 | Pitts |
| 2007/0114236 | A1 | 5/2007 | Shiffer et al. |
| 2007/0164026 | A1 | 7/2007 | Morrissey et al. |
| 2007/0199945 | A1 | 8/2007 | Ho |
| 2008/0011762 | A1 | 1/2008 | Boone |
| 2008/0061069 | A1 | 3/2008 | Edelstein et al. |
| 2008/0245792 | A1 | 10/2008 | Chou |
| 2009/0266828 | A1 | 10/2009 | Cai |
| 2009/0266829 | A1 | 10/2009 | Bailey |
| 2009/0294459 | A1 | 12/2009 | Hovsepian et al. |
| 2009/0294460 | A1 | 12/2009 | Hovsepian et al. |
| 2011/0114655 | A1 | 5/2011 | Bailey |
| 2011/0266294 | A1 | 11/2011 | Charbonnet et al. |
| 2012/0024871 | A1 | 2/2012 | Hundley et al. |
| 2012/0152968 | A1 | 6/2012 | Bailey |
| 2014/0057023 | A1 | 2/2014 | Sabaga et al. |
| 2015/0223625 | A1 | 8/2015 | Fleming |
| 2017/0303713 | A1 | 10/2017 | Fleming |
| 2018/0127168 | A1 | 5/2018 | Fleming |
| 2020/0029711 | A1* | 1/2020 | Brannock ..... B65D 51/16 |

FOREIGN PATENT DOCUMENTS

| | | | | |
|---|---|---|---|---|
| CA | 2539528 | A1 | | 9/2006 |
| CA | 2635219 | | | 7/2008 |
| CN | 1328522 | A | | 12/2001 |
| CN | 1585716 | A | | 2/2005 |
| CN | 1840433 | A | | 10/2006 |
| EP | 1230130 | B1 | | 2/2004 |
| EP | 1118549 | B1 | | 5/2006 |
| EP | 1043243 | B1 | | 9/2006 |
| EP | 2121465 | B1 | | 12/2013 |
| EP | 002469494-0001 | | | 5/2014 |
| GB | 2307633 | A | | 6/1997 |
| GB | 2322289 | A | | 6/1998 |
| JP | 09-156661 | A | | 6/1997 |
| KR | 20170066204 | A | * | 6/2017 |
| WO | WO 96/39068 | | | 12/1996 |
| WO | WO 2009/008587 | A1 | | 1/2009 |
| WO | WO 2009/036426 | A2 | | 3/2009 |
| WO | WO 2010/042027 | A1 | | 4/2010 |
| WO | WO 2011/024012 | A1 | | 3/2011 |
| WO | WO-2014014844 | A1 | * | 1/2014 ..... B65D 43/0212 |
| WO | WO 2015/123150 | A1 | | 8/2015 |
| WO | WO-2018096503 | A1 | * | 5/2018 ..... A47G 19/2272 |

OTHER PUBLICATIONS

Louise Harpman & Scott Specht, Cabinet Magazine, Inventory/Peel, Pucker, Pinch, Puncture. Issue 19, Chance Fall 2005 (2005-09-00), http://www.cabinetmagazine.org/issues/19/harpman.php (4 pages).

Nicolas, Edible Geography, The Evolution of Lids. (May 9, 2011), http://www.ediblegeography.com/the-evolution-of-lids/ (7 pages).

Supplemental European Search Report & Opinion dated Sep. 30, 2015 European Patent Application No. EP13763858 (dated Oct. 9, 2015) (6 pgs).

➤ Date unknown. Printed Nov. 15, 2013. Product Design (physical goods): Why is the Solo Traveler the dominant coffee cup lid? http://www.quora.com/Product-Design-physical-goods/Why-is-the-Solo-Traveler-the-dominant-coffee-cup-lid (7 pages).

"The Viora Lid Finally Solves the Problem of Terribly Designed Disposable Coffee Cup Lids", WallStreetinsanity.com, pp. 1-4 of 14 pages attached. Published May 15, 2014 online at http://wallstreetinsanity.com/the-viora-lid-finally-solves-the-problem-of-terribly-designed-disposable-coffee-cup-lids/.

PCT International Search Report—PCT/US2015/015069 (dated May 15, 2015) ISA:—Korean Intellectual Property Office (3 pages).

PCT Written Opinion of the International Searching Authority—PCT/US2015/015069 (dated May 15, 2015) ISA:—Korean Intellectual Property Office (10 pages).

Notification Concerning Transmittal of International Preliminary Report on Patentability—dated: Aug. 25, 2016 with International Preliminary Report on Patentability ; Written Opinion of the Internatinoal Searching Authority—dated Aug. 25, 2016 (PCT/US2015/015069) (12 pages).

Search Report—The State Intellectual Property Office of the People's Republic of China, dated Oct. 22, 2015 Chinese Patent Application No. 201380016011.2 Chinese Language.

Search Report—The State Intellectual Property Office of the People's Republic of China, dated Oct. 22, 2015 Chinese Patent Application No. 201380016011.2 English Translation.

CN 1328522 A (Dec. 26, 2001)—Espacenet Bibliographic data with EPO Patent Translate—Description and Claims—Machine Translation—English.

CN 1585716 A (Feb. 23, 2005)—Espacenet Bibliographic data with EPO Patent Translate—Description and Claims of coresponding documents US2003098714A1—Machine Translation—English.

CN 1840433 A (Oct. 4, 2006)—Espacenet Bibliographic data with EPO Patent Translate—Description and Claims—Machine Translation—English.

* cited by examiner

©2017, 2018, by VAPORPATH, INC.

©2017, 2018, by VAPORPATH, INC.

©2017, 2018, by VAPORPATH, INC.

©2017, 2018, by VAPORPATH, INC.

©2017, 2018, by VAPORPATH, INC.

©2017, 2018, by VAPORPATH, INC.

©2017, 2018, by VAPORPATH, INC.

©2017, 2018, by VAPORPATH, INC.

©2017, 2018, by VAPORPATH, INC.

©2017, 2018, by VAPORPATH, INC.

©2017, 2018, by VAPORPATH, INC.

©2017, 2018, by VAPORPATH, INC.

©2017, 2018, by VAPORPATH, INC.

©2017, 2018, by VAPORPATH, INC.

©2017, 2018, by VAPORPATH, INC.

©2017, 2018, by VAPORPATH, INC.

©2017, 2018, by VAPORPATH, INC.

©2017, 2018, by VAPORPATH, INC.

©2017, 2018, by VAPORPATH, INC.

©2017, 2018, by VAPORPATH, INC.

©2017, 2018, by VAPORPATH, INC.

©2017, 2018, by VAPORPATH, INC.

©2017, 2018, by VAPORPATH, INC.

©2017, 2018, by VAPORPATH, INC.

DRINK-THROUGH RECLOSABLE SPILL RESISTANT BEVERAGE CUP LID WITH VENT STRUCTURE

RELATED PATENT APPLICATIONS

This application claims priority from prior U.S. Provisional Patent Application Ser. No. 62/652,294, filed Apr. 3, 2018, entitled DRINK-THROUGH RECLOSABLE SPILL RESISTANT BEVERAGE CONTAINER LID WITH VENT STRUCTURE and U.S. Provisional Patent Application Ser. No. 62/535,786, filed Jul. 21, 2017, entitled DRINK-THROUGH BEVERAGE CONTAINER LID WITH RECLOSABLE SPILL RESISTANT STRUCTURE, the disclosures of each of which are incorporated herein in their entirety, including the specification, drawing, and claims, by this reference.

STATEMENT OF GOVERNMENT INTEREST

Not Applicable.

COPYRIGHT RIGHTS IN THE DRAWING

A portion of the disclosure of this patent document contains material that is subject to copyright protection. The patent owner has no objection to the facsimile reproduction by anyone of the patent document or the patent disclosure, as it appears in the Patent and Trademark Office patent file or records, but otherwise reserves all copyright rights whatsoever.

TECHNICAL FIELD

This disclosure relates to lids for drinking cups, and more specifically, to a drink-through lid for beverage containers, and elements thereof useful to minimize or substantially avoid escape of liquids through the lid.

BACKGROUND

Disposable beverage containers—of the type known as cups and which are described herein as drinking cups or beverage cups—are ubiquitous for use in "on-the-go" consumption of liquids, particularly hot beverages such as coffee or tea. Disposable beverage cups often utilize a disposable lid. Various lid designs include openings therein, or openable portions therein, configured with the idea of minimizing splashing or spilling of the beverage from the cup.

One type of disposable lid that is now widely used is a drink-through type lid that provides a horizontally oriented drink outlet on a top surface of a raised rim. Such a design allows a user to drink-through the lid in a manner similar in many respects to drinking through a straw, in that it usually seems that a limited amount of liquid is provided through the small opening. Unfortunately, and especially during transport, lids with such openings may allow escape of liquid (especially when full), unless the drink outlet is sealed, such as by use of a stopper or plug. Consequently, spill prevention devices used with such designs do not allow drinking without subsequent removal of the stopper or plug. Similarly, other disposable lids have been provided that include rip-open tabs that lift to allow drinking, but which prevent drinking until such tabs are removed.

Thus, there remains a need to provide a lid design for a disposable beverage cup or container that simultaneously minimizes or avoids spill of liquid from the beverage cup or container, while allowing the user to drink from the cup or container. It would be even more advantageous for such a lid design to be provided in a single piece, low cost, disposable material. It would be additionally desirable if such a lid design were available in a configuration that is easy to ship, compact for storage, and easy to install at point of sale. Further, it would be desirable if such a lid enhanced ease of use, by substantially preventing liquid spill during transport, while allowing drinking when opened, yet easily enabling the lid to be reversibly resealed to prevent spillage of liquid through the lid.

SUMMARY

Novel spill resistant structures have been developed for use with drink-through type beverage cup lids. Concurrently, drink-through lid designs have been developed in which such spill resistant structures may be fabricated, such as during manufacture of lids by thermoforming. In various embodiments, drink-through lids with such spill resistant structures significantly enhance a user's beverage drinking experience as compared to various prior art drink-through lids for beverage cups. Various embodiments of novel spill resistant structures allow prevention, or at least minimization of liquid spills from a beverage cup, while allowing a user to drink from the cup or beverage container without the necessity of removing rip-open tabs, or removing closure features such as plugs or stoppers.

In an embodiment, a drink-through lid for a beverage cup having an open end is provided, with integrally fabricated spill resistant features. In an embodiment, the drink-through lid is provided with a base having a rim with a bottom edge, and an interior bead sealing portion. The base is sized and shaped to sealingly engage the open end of the beverage cup. The drink-through lid is provided with a raised lip portion having an exterior portion extending upwardly from the base. A raised outer lip portion is provided, and an interior portion is provided sloping downwardly from the outer lip portion to lower end portions. A drink well base is provided, having a floor extending inward from a peripheral side adjacent the lower end portions of the interior portion. The drink well base located downward from the outer lip portion. In an embodiment, a downwardly sloped central wall may be provided. Such a downwardly sloped central wall extends across at least a portion of the drink-through lid, and further includes an interior hinge at the lower reaches thereof. A downwardly sloped first sidewall and a downwardly sloped second sidewall may be provided adjacent the downwardly sloped central wall. Each of the first and second downwardly sloped sidewalls have an interior edge adjacent to the downwardly sloped central wall, and each of the first and second downwardly sloped sidewalls have a lower edge portion. Along the lower edge portion of the first and second downwardly sloped sidewalls, a first slit and a second slit, respectively, are provided. In an embodiment, an actuator may be provided. In an embodiment, opening and closing of a flexible structure may be provided by manipulation only of the flexible structure itself. When an actuator is used, it may include an upper surface, an outer face, a first actuator sidewall and a second actuator sidewall. The upper surface of the actuator may include an inner portion joined with and pivotable at an interior hinge. The first actuator sidewall and the second actuator sidewall may each have lower ends, which adjoin the first slit and the second slit, respectively. A flexible structure may be provided extending across the drink well floor to the interior portion of the raised lip portion. Where an actuator is utilized, the flexible structure may extend from the outer face of the actuator to the interior portion of the raised lip portion. The flexible structure may include a stiffener and a plurality of panels. The stiffener extends outward from the outer face of the actuator. An outer slit separates the flexible structure from the interior portion, so as to define a drink outlet when the flexible stiffener is placed into a downward, open position. Inner slits may be provided to separate the flexible structure from other portions of the lid, such as an outer face of an actuator, to provide vent structures in the drink-through lid.

In an embodiment, a plurality of hinges may be provided between a stiffener in the flexible structure and one or more of the plurality of panels, to provide a structure wherein the stiffener, hinges, and plurality of panels are sufficiently flexible so that the flexible structure is reversibly positionable between an upward, closed position and a downward, open position. In the downward, open position, a drink outlet is provided in the interior portion of the raised lip portion as defined by an outer slit. However, the stiffener, hinges, and plurality of panels are sufficiently stiff so that the flexible structure remains positioned at either an upward closed position or in a downward open position, after manipulation, whether in an embodiment with an actuator or otherwise.

In an embodiment, the hinges between the stiffener and the flexible structure may be provided having a valley shape. In an embodiment, such valley shape may be generally a U-shaped structure.

In an embodiment, the flexible structure may have an outer end which is positionable, when in the open position, substantially prevent, or at least minimize, the upward flow of liquid from the interior of a beverage cup and to the drink outlet. Thus, direct splash of liquid from the interior of a beverage cup, outward through the drink outlet, is effectively prevented.

BRIEF DESCRIPTION OF THE DRAWING

The present invention(s) will be described by way of exemplary embodiments, using for illustration the accompanying drawing in which like reference numerals denote like elements, and in which.

Figure 1:
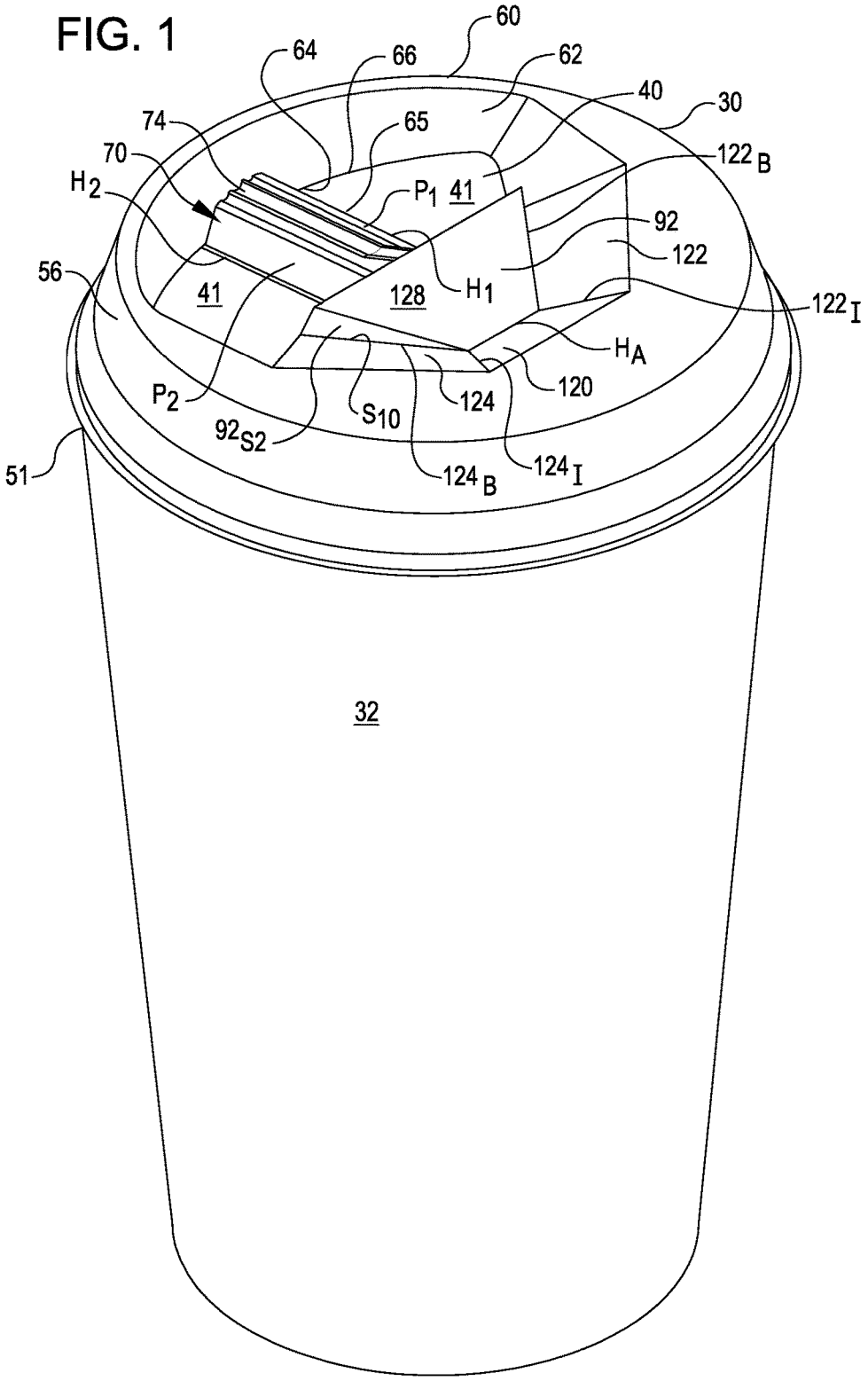
FIG. 1 is a perspective view of an embodiment for a drink-through lid for a cup, having a drink well base into which liquid emerges for consumption, and which also shows a flexible structure extending from the outer face of an actuator to the interior portion of the raised lip portion of the lid.

The foregoing figures, being merely exemplary, contain various elements that may be present or omitted from a final configuration for a drink-through disposable lid suitable for use with a spill resistant flexible structure which is reversibly positionable between a drink outlet closed position and a drink outlet open position, using the principles described herein, or that may be implemented in various embodiments described herein for such drink-through lids. Other variations in drink-through lid designs with spill resistant features may use slightly different mechanical structures, angular configurations, mechanical fit arrangements, liquid flow configurations, or vapor flow configurations, and yet employ the principles described herein and as generally depicted in the drawing figures provided. An attempt has been made to draw the figures in a way that illustrates at least those elements that are significant for an understanding of exemplary drink-through lid with spill resistant flexible structures for use on beverage containers. Such details may be quite useful for providing a high quality improved beverage container drink-through lids with spill resistant flexible structures, for use in both minimizing spills, and enabling a user to reclose the lid after initially drinking from the lid.

It should be understood that various features may be utilized in accord with the teachings hereof, as may be useful in different embodiments as useful for various sizes and shapes of cups, drink-through lids, and spill resistant flexible structures, within the scope and coverage of the teachings herein as defined by the claims. Further, like features in various lid and spill resistant flexible structures may be described using like reference numerals, or other like references, without further mention thereof.

DETAILED DESCRIPTION

Figure 2:
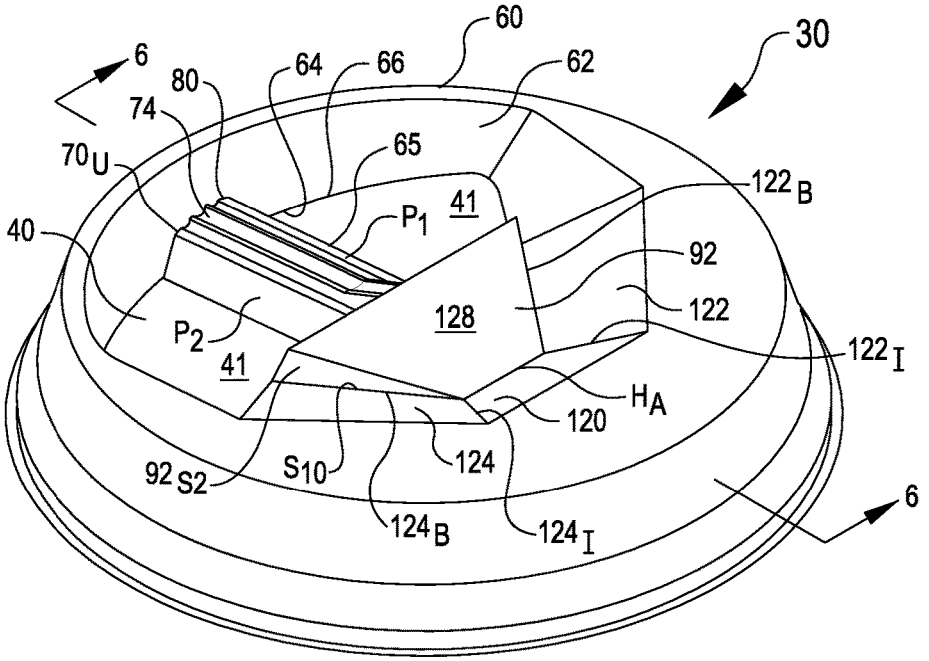
FIG. 2 is a perspective of an embodiment for a drink-through lid for a cup, having a drink well base into which liquid emerges for consumption, and which also shows a flexible structure extending from the outer face of an actuator to the interior portion of the raised lip portion of the lid, with the actuator shown in an upward position, so that the drink outlet is closed.
Figure 3:
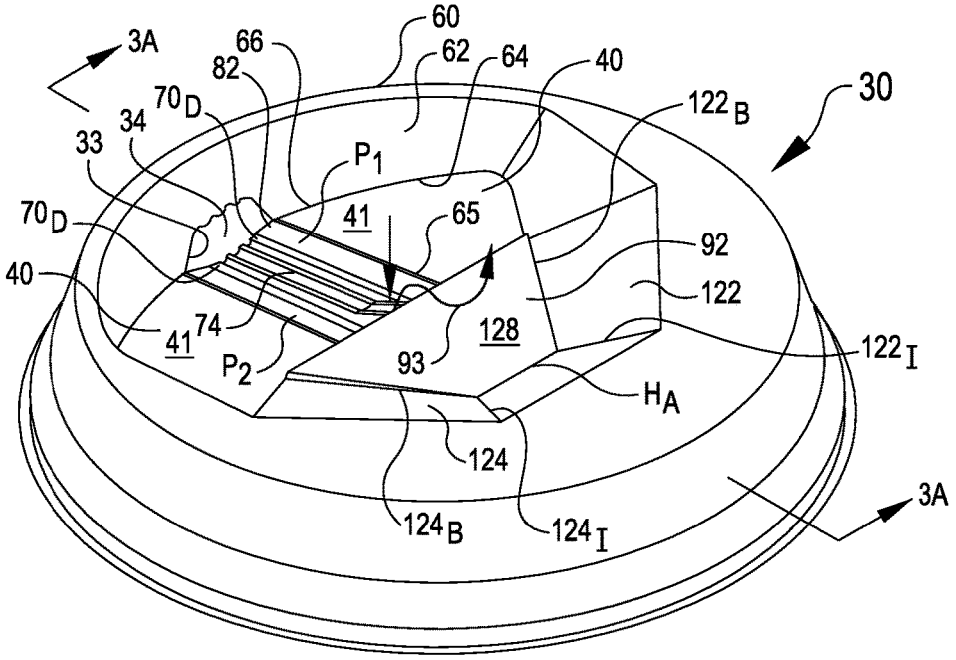
FIG. 3 is a perspective of an embodiment for a drink-through lid for a cup, having a drink well base into which liquid emerges for consumption, and which also shows a flexible structure extending from the outer face of an actuator to the interior portion of the raised lip portion of the lid, with the actuator shown in an downward position, so that the drink outlet is open.

Attention is directed to FIGS. 1, 2 and 3, where a first embodiment for a drink-through lid 30 for a beverage container 32 is provided. A lid 30 provides at least one drink outlet 34 (see FIG. 3) defined in part by upper edge wall 33 that allows liquid 36 (see FIG. 3A) to fill a drink well base 40 (better seen in FIG. 3), from which a user or consumer may sip a beverage in a manner similar to when using a cup or mug. Extensive details of exemplary embodiments of drink-through lids which may be useful with beverage containers 32, and which in some cases have been provided for use with a spill resistant structure have previously been described (a) in U.S. Pat. No. 8,950,623 B2, issued Feb. 10, 2015, entitled Beverage Container Lid That Provides Natural Drinking Experience, (b) in U.S. Pat. No. 9,642,483 B2, issued May 9, 2017, entitled Beverage Container Lid That Provides Natural Drinking Experience, (c) in U.S. Pat. No. D722,498 S, issued Feb. 17, 2015, entitled Lid for Beverage Container, and (d) in U.S. Pat. No. D708,515 S, issued Jul. 8, 2014, entitled Lid for Beverage Container, the disclosures of each of which are incorporated herein by reference in their entirety, including the specification, the claims, and the drawing figures of each patent or patent application.

Figure 5:
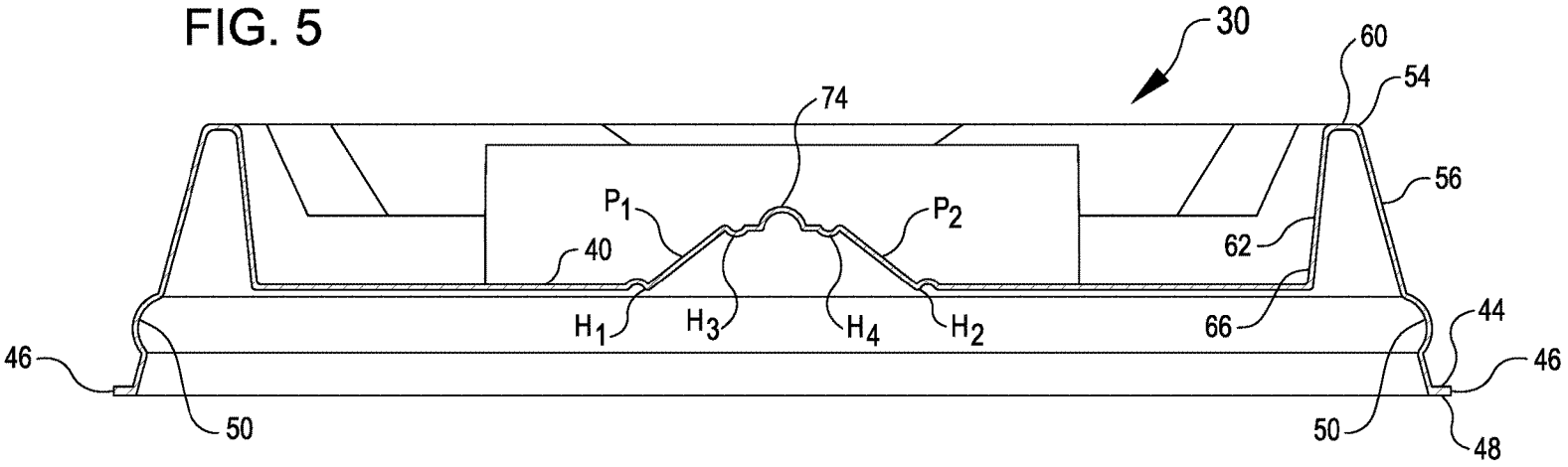
FIG. 5 is a vertical cross-sectional view taken through line 5-5 of FIG. 4, and in which the drink-through lid is shown with the flexible structure in the upward, drink outlet closed position.
Figure 6:
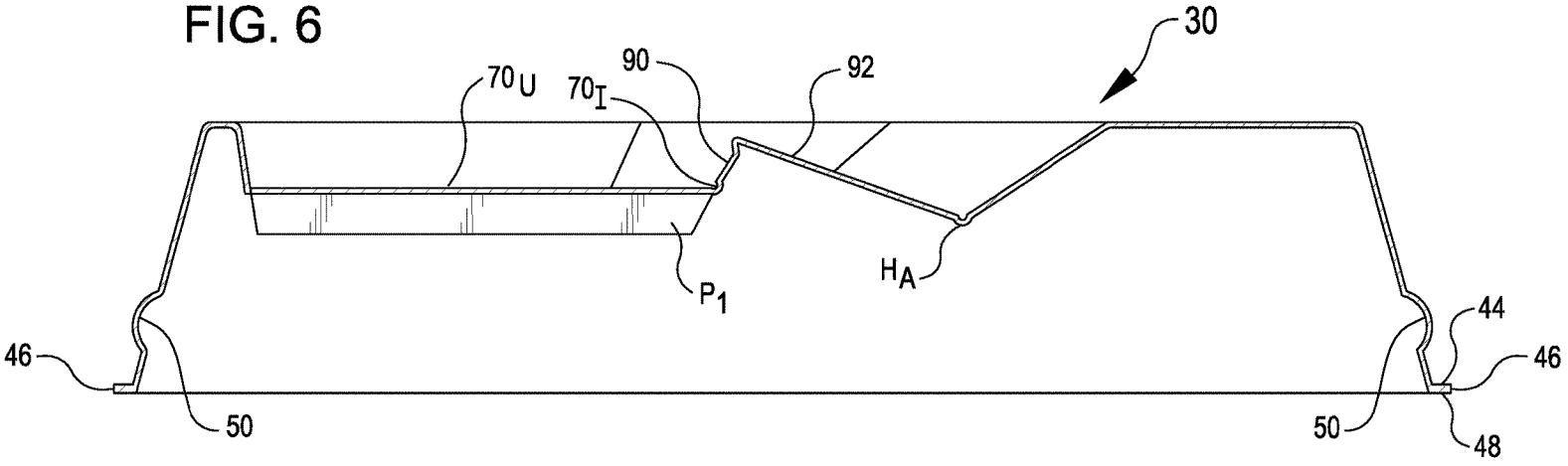
FIG. 6 is a vertical cross-sectional view taken through line 6-6 of FIG. 2, and in which the drink-through lid is shown with the flexible structure in the upward, drink outlet closed position.

As may be better appreciated by reference to FIGS. 5 and 6, a lid 30 may include a base 44 with rim 46 having a bottom edge 48, and an interior bead sealing portion 50. In an embodiment, rim 46 may be annular in shape. The base 44 is sized and shaped to sealingly engage, with bead sealing portion 50, an open end 51 (generally circular) of beverage container 32, which may be defined by a bead 53 (see FIG. 3A) of a beverage container 32. A hollow raised lip portion 54 is provided on lid 30, and it has an exterior portion 56 extending upwardly, an outer lip portion 60, and an interior portion 62 sloping downwardly and inwardly from the outer lip portion 60 to lower end portions 66.

A drink well base 40 for containing liquid 36 is provided. The drink well base 40 has a floor 41 extending from a peripheral side 64 (see FIG. 1, 2, 3, or 11) along at least some of the lower end portions 66. In an embodiment, the floor 41 may extend upwardly and inwardly from the peripheral side 64. In an embodiment, the drink well base 40 may be located downward, and in an embodiment, inward from the interior portion 62 of the outer lip portion 60 of drink-through lid 30. In various embodiments, as may be seen in FIGS. 1 and 4, a flexible structure 70 may be provided, which may extend across the drink well base 40 from the interior portion 62 of the raised lip portion 54. In various embodiments, as further described herein, the flexible structure 70 may include a plurality of panels $P_1$ through $P_x$, a stiffener 74, and plurality of hinges $H_1$ through $H_N$, wherein N is a positive integer. In an embodiment a plurality of hinges, e.g. a first base hinge Hand a second base hinge $H_2$, may be located between another component of the flexible structure 70 and a floor edge 65 of the drink well base 40. In this manner, the flexible structure 70 may be provided adjustably positionable from an upward shaped structure $\mathbf{70}_U$ as shown in FIG. 2, wherein a drink outlet 34 is effectively closed, to a downwardly shaped structure $\mathbf{70}_D$, as shown in FIG. 3, wherein the drink outlet 34 is open for passage of a liquid from the cup 32 into the floor 41 of drink well base 40, as indicated by reference arrow 75.

In various embodiments, an outer slit 80 (see FIG. 2) is provided between the flexible structure 70 and the interior portion 62 of the raised lip portion 54, so that when the flexible structure 70 is positioned as a downwardly shaped structure $\mathbf{70}_D$, the outer slit 80 defines a drink outlet 34 between the interior portion 62 of the raised lip portion 54. The upper portion of the drink outlet 34 is defined by upper edge wall 33 (see FIG. 3), and the lower portion of the drink outlet 34 is defined by the outer end 82 of the flexible structure 70 in its downward position $\mathbf{70}_D$. In various embodiments, the outer end 82 of the flexible structure 70 (when in the downward position $\mathbf{70}_D$) may be sized, shaped, and located to provide splash protection so as to resist movement of liquid outward from a beverage cup 32 via the drink outlet 34.

As further appreciated by reference to FIG. 3, a drink-through lid 30 may be provided wherein the flexible structure 70 has an outer end 82 that is sized, shaped, and located, when the flexible structure 70 is positioned in its downwardly position $\mathbf{70}_D$, to drain liquid 36 (see FIG. 3A) which remains in the drink well base 40 into the beverage cup 32 therebelow.

In an embodiment, a drink-through lid 30 may be provided wherein the flexible structure 70 includes a plurality of flat panels $P_1$ through $P_X$, wherein X is a positive integer. In various embodiments, one or more of the plurality of panels $P_1$ through $P_X$ may be provided as a rectangular shaped panel. In other embodiments (e.g., see FIGS. 15 and 16) one or more of the plurality of flat panels $P_1$ through $P_X$ may be a trapezoidal shaped panel. In various embodiments, panels $P_1$ through $P_X$ may flat, e.g., planar.

Figure 3A:
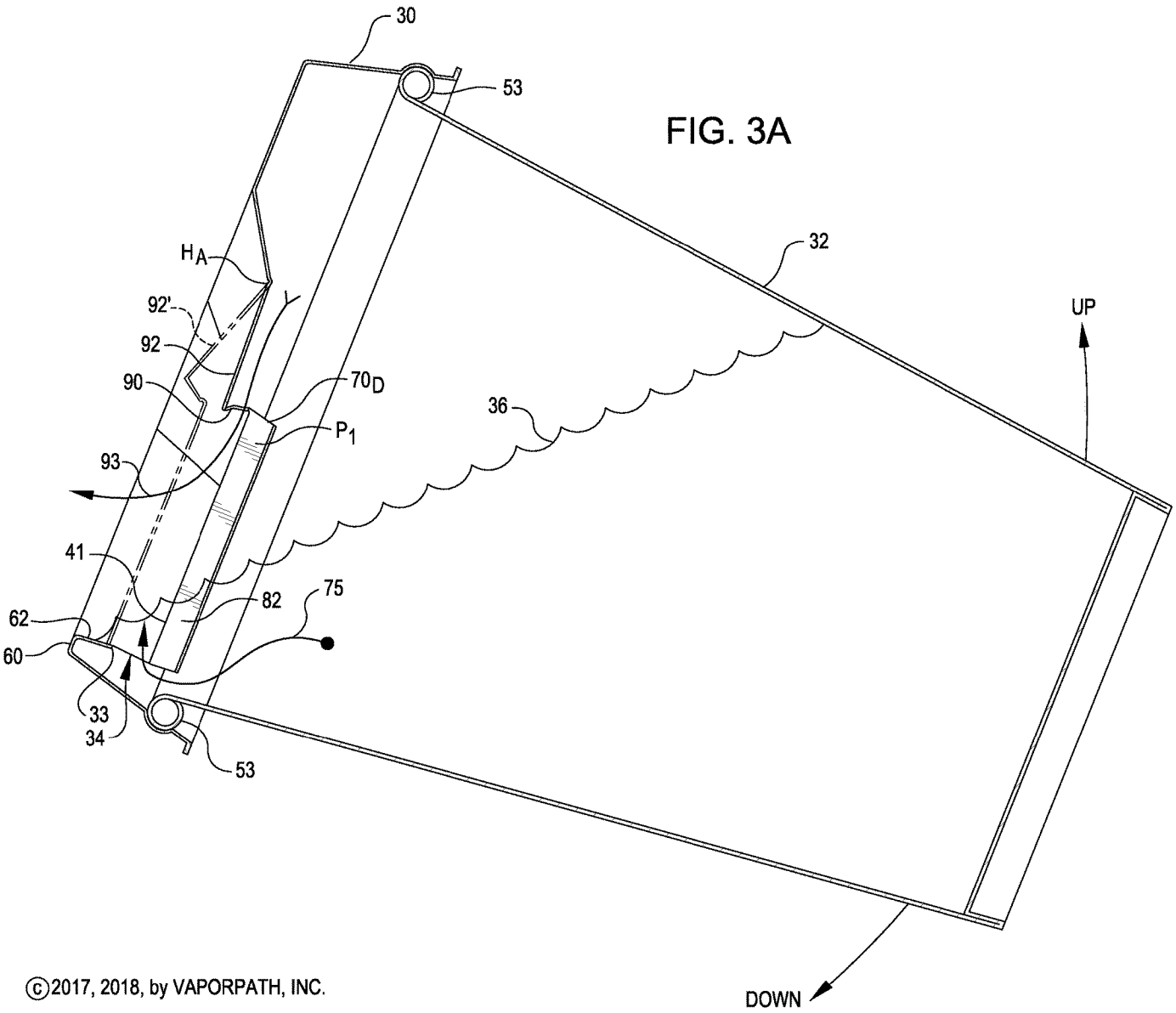
FIG. 3A is cross-sectional view of an embodiment for a drink-through lid for a beverage container, taken through line 3A-3A of FIG. 3, showing the lid on a beverage container having liquid therein, and showing the flexible structure in a downward position in which liquid emerges through a drink outlet for consumption, and which also shows liquid in the drink well base; also shown in broken lines the position of the flexible structure when in the upward, drink outlet closed position.
Figure 4:
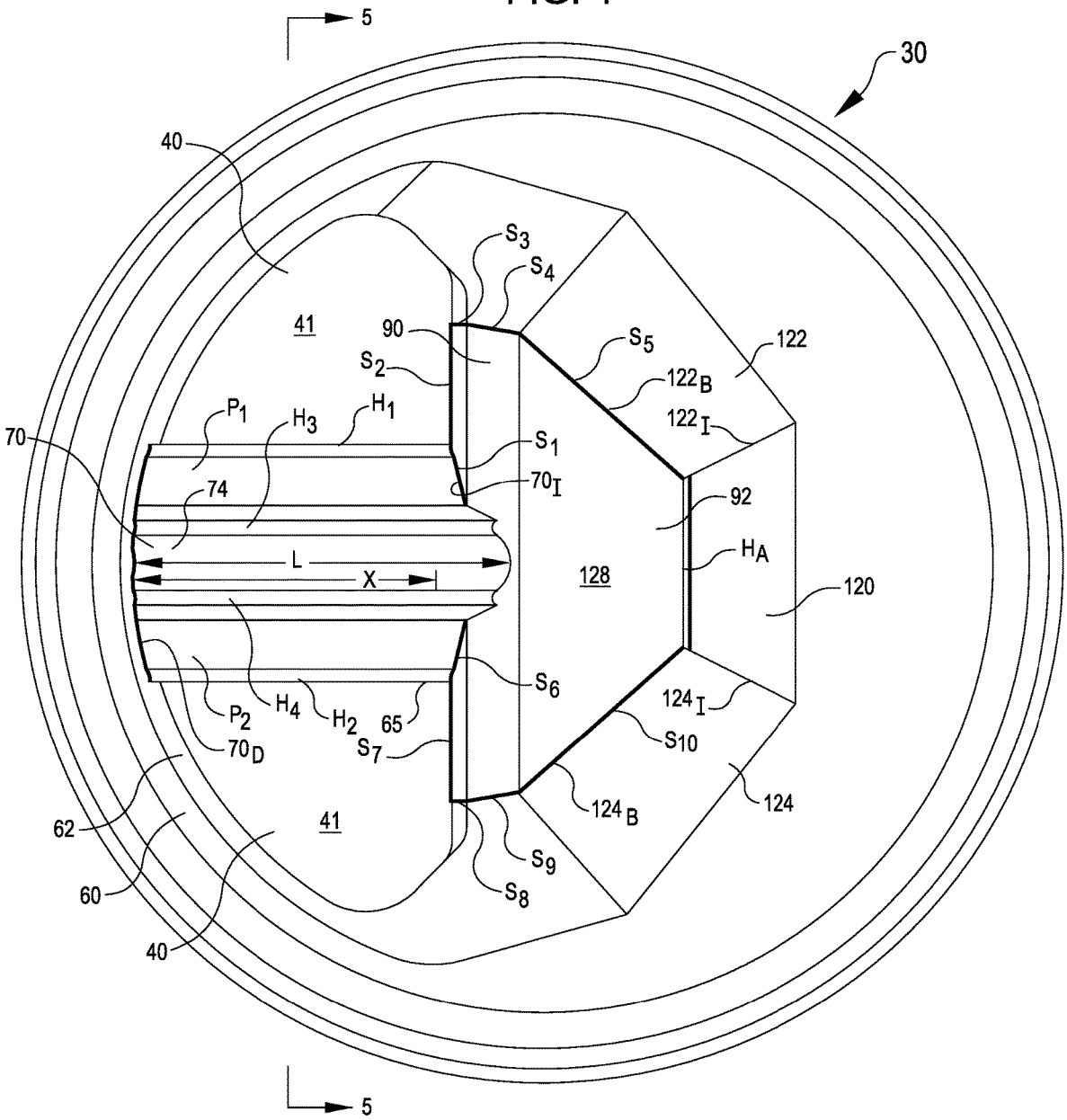
FIG. 4 is a plan view of an embodiment for a drink-through lid for a cup, having a drink well base into which liquid emerges for consumption, and which shows a flexible structure extending from the outer face of an actuator to the interior portion of the raised lip portion of the lid, with the actuator shown in an upward position, so that the drink outlet is closed, and further showing in heavy lines the various locations where "cuts" or "slits" are provided, so that the lid may be reversibly positioned between a drink outlet closed position and a drink outlet open position.

Further details of some embodiments are illustrated in FIGS. 4 and 5, where FIG. 5 is a cross-section taken across line 5-5 of FIG. 4. FIG. 4 provides a plan view of an embodiment for a drink-through lid 30 for a beverage container 32. The flexible structure 70 extends outward from the outer face 90 of an actuator 92 to the interior portion 62 of the raised lip 54 portion of the lid 30. In FIGS. 4 and 5, the actuator 92 is shown in an upward position, so that the drink outlet 34 (see FIG. 3) is closed. In FIG. 3A, the closed position for the drink outlet 34 is provided by the location of actuator 92' seen in broken lines, and in the drink outlet 34 open position by actuator 92 and flexible structure $\mathbf{70}_D$ as seen in solid lines. FIG. 4 also shows, using heavy lines $S_1$ through $S_Z$ (wherein Z is a positive integer) the various locations where "cuts" or "slits" $S_1$ through $S_Z$ are provided. In an embodiment, flexibility of the flexible structure 70 is in part provided by slits $S_1$ through $S_Z$ so that the lid 30 may be reversibly positioned between a drink outlet 34 closed position (see FIG. 2) and a drink outlet open position (see FIG. 3). In an embodiment, drink-through lid 30 including a plurality of slits may be configured so that one or more of the plurality of inner slits (e.g. S1, S2, or S9 or S10 in FIG. 4) separating the flexible structure 70 from portions of the outer face 90 of the actuator 92 are sized and shaped to provide vent openings, as may be understood by reference to reference line 93 in FIGS. 3 and 3A showing vent vapors emerging outward from drink-through lid 30 when the flexible structure 70 is in the downward position $\mathbf{70}_D$ with the drink outlet 34 open.

Figure 7:
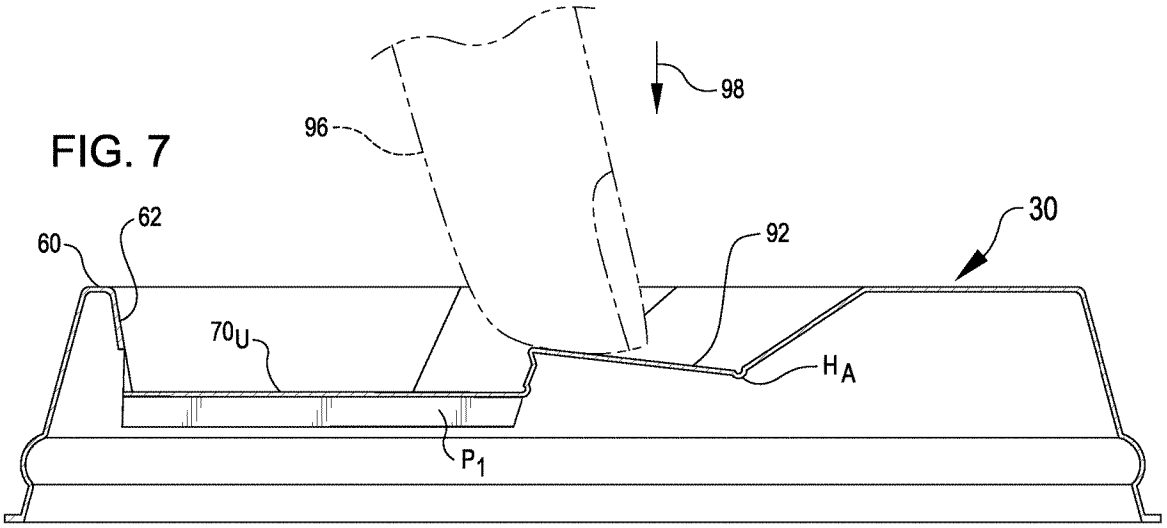
FIG. 7 is a vertical cross-sectional view, similar to that just shown in FIG. 6 above, but now showing the drink-through lid wherein the actuator is being pressed downward by a user's finger, so that the actuator is started downward, compared to the position shown in FIG. 6.
Figure 8:
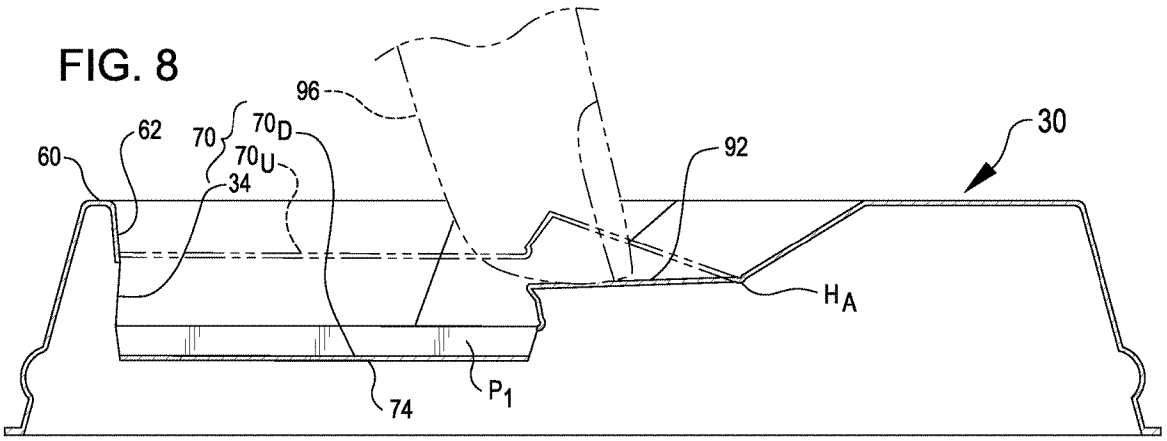
FIG. 8 is a vertical cross-sectional view, similar to that just shown in FIGS. 6 and 7 above, but now further showing in broken lines the original, upward and closed position of the actuator and flexible structure, (as was shown in FIG. 6 above), and showing in solid lines the completed movement of the actuator to place the flexible structure in a downward, drink outlet open position.

Attention is now directed to FIGS. 6, 7, and 8, in which vertical cross-sectional views are provided for lid 30 in various configurations. In FIG. 6, the flexible structure 70 is illustrated in an upward, drink outlet 34 closed position noted as $\mathbf{70}_U$ above. In FIG. 7, a vertical cross-sectional view is provided similar to that just shown in FIG. 6 above, but now showing the drink-through lid wherein the actuator 92 is being pressed downward by a user's finger 96 in the direction of reference arrow 98, so that the actuator is moving downward, as compared to the position of the actuator and the flexible structure 70 shown in FIG. 6. Finally, in FIG. 8, a vertical cross-sectional view is provided to show the flexible structure 70 in broken lines $\mathbf{70}_U$ in the original, upward position, wherein the drink outlet 34 is closed. FIG. 8 also provides in cross-section lines an illustration of the completed movement of the actuator 92 which has placed the flexible structure 70 in a downward position $\mathbf{70}_D$, with the drink outlet 34 in an open position In the embodiment shown in FIGS. 1, 2 and 5, the flexible structure 70 is provided in a downward oriented generally W-shaped structure, wherein a stiffener 74 provides the center of the W-shaped structure. In an embodiment as see in FIG. 4A, the flexible structure 70 may include a downward oriented generally trough shaped structure, wherein a stiffener 101 provides the center of the trough. As seen in FIG. 4, in various embodiments, the stiffener 74 may be provided having a length L extending from a stiffener inner end to a stiffener outer end, and wherein at least portions of the stiffener 74 along said length L afford contact with the flexible structure 70 at an effective distance X from the interior portion 62, so that the flexible structure 70 is positionable from a closed position $\mathbf{70}_U$ as an upwardly shaped flexible structure 70, to an open position $\mathbf{70}_D$ as a downwardly shaped flexible structure 70. As also seen in FIG. 4, in an embodiment, a flexible structure 70 may include an interior end $\mathbf{70}_I$. A first interior slit $S_1$ may be located along at least a portion of the interior end $\mathbf{70}_I$of the flexible structure 70. In various embodiments, an actuator 92 may be formed with, or affixed to, the stiffener 74. In other embodiments, as further seen in FIGS. 28, 29, and 30 discussed below, a stiffener 708 may further include a rib 712, which in an embodiment, may be provided in a ramp type shape.

Figure 9:
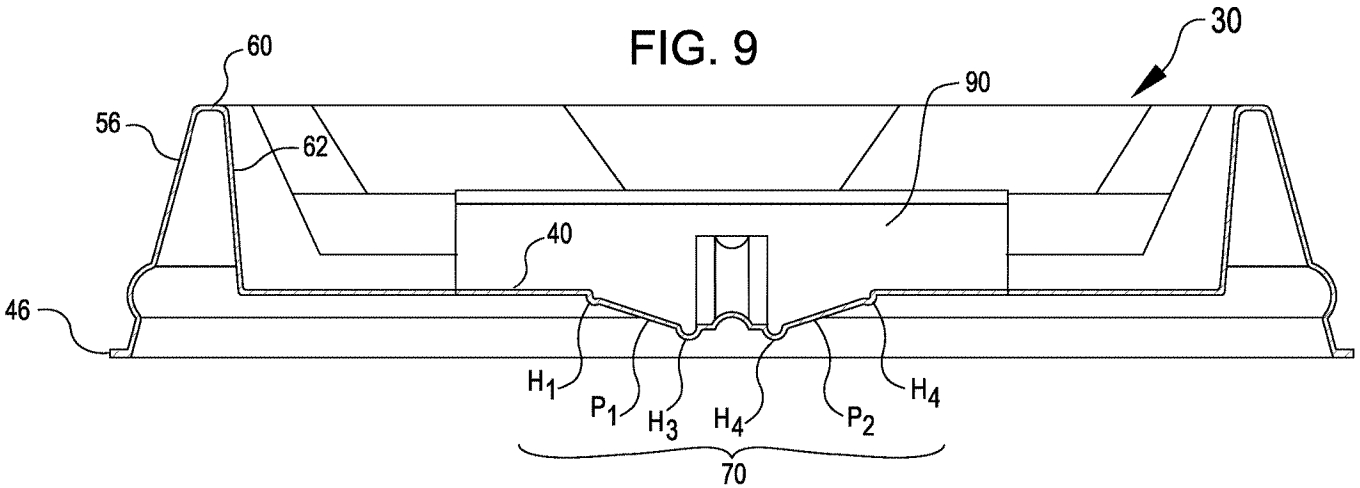
FIG. 9 is a vertical cross-sectional view similar to that taken as if through line 5-5 of FIG. 4, but instead of the flexible structure in the upward, closed position as illustrated in FIGS. 4 and 5, the flexible structure is now located in the downward, drink outlet open position.

Attention is now directed to FIG. 9, which presents a vertical cross-sectional view taken similar to the view presented through line 5-5 of FIG. 4, but now instead of the flexible structure 70 in the upward, closed position $\mathbf{70}_U$ as illustrated in FIGS. 4 and 5, the flexible structure 70 is now located in the downward, drink outlet open position $\mathbf{70}_D$.

Figure 10:
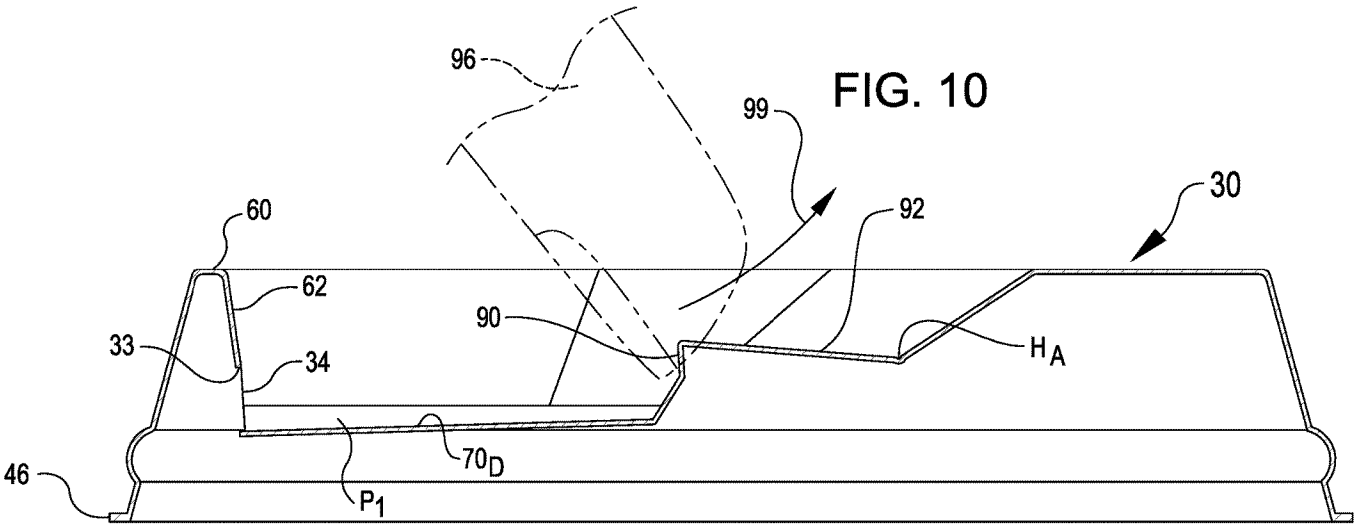
FIG. 10 is a vertical cross-sectional view similar to that taken as if through line 2-2 of FIG. 2, but now showing the movement of the flexible structure from the downward, drink outlet open position (shown in broken lines), by manual manipulation, toward the upward, drink outlet closed position, as illustrated in the completely closed position in FIG. 6 above.

In FIG. 10, the movement of the flexible structure 70 from the downward, drink outlet open position $\mathbf{70}_D$ by finger 96 (shown in hidden lines), by manual manipulation in the direction indicated by reference arrow 99, toward the upward, drink outlet closed position $\mathbf{70}_U$, as illustrated in FIG. 6.

In some embodiments, hinges, rather than slits such as slits $S_1$ through $S_Z$, may be utilized. Such an embodiment is set out in FIG. 4A, which provides plan view of an embodiment for a drink-through lid 100. Lid 100 is similar to the embodiment for lid 30 just shown in FIG. 4, but now illustrates the use of an actuator 102 which includes and utilizes hinges (e.g., hinges $H_{11}$, $H_{12}$, $H_{13}$, and $H_{14}$ shown using double lines in FIG. 4A) rather than slits (e.g. slits $S_1$, $S_2$, $S_3$, $S_4$, $S_{11}$, $S_6$, $S_7$, $S_8$, $S_9$, and $S_{12}$) shown in heavy dark lines), between the actuator 102 and other portions of lid 100. Such hinges are comparable functionally to the embodiments described using slits, since when using hinges the flexible structure 104 provided in lid 100 may be reversibly positioned between a drink outlet closed position and a drink outlet open position, as described and shown in relation to FIGS. 2 and 3 above. Flexible structure 104 includes the collection of components, i.e. hinges and panels, mutatis mutandis, as noted in FIG. 25 as regards flexible structure 402, or in FIG. 25A as regards flexible structure 502. In various embodiments, one or more of the plurality of hinges may be provided as a valley shaped structure. In various embodiments, the valley shaped structures may be provided in a generally U-shaped structure. In various embodiments, one or more of the plurality of hinges may be provided as a ridge shaped structure. In various embodiments, the ridge shaped structures may be provided in a generally upside down partial U-shaped structure.

Figure 11:
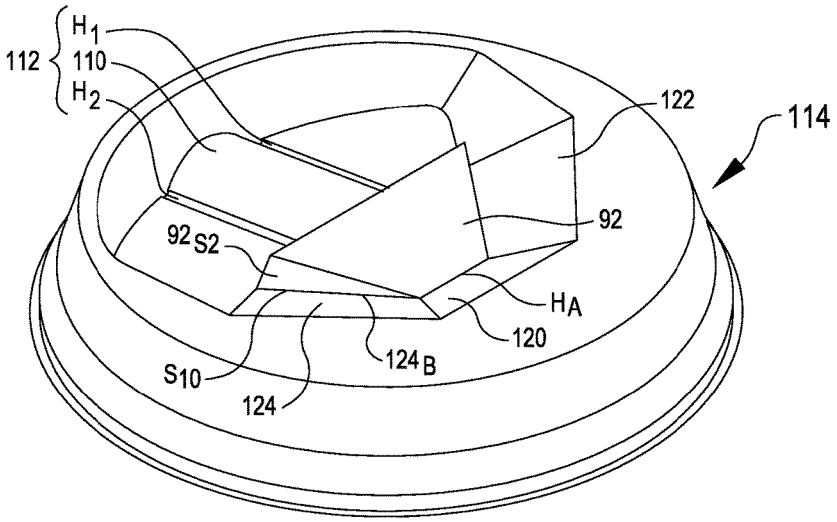
FIG. 11 is a perspective of an embodiment for a drink-through lid for a cup, having a drink well base into which liquid emerges for consumption, and which also shows a flexible structure extending from the outer face of an actuator to the interior portion of the raised lip portion of the lid, with the actuator shown in an upward position, so that the drink outlet is closed, and with the flexible structure shown using, at least in part, a curved, surface, which in an embodiment may be a partial cylindrical shaped surface of constant radius, or may alternately be an elliptically shaped surface portion, or may be another curved surface shape rising upward from the drink well base.
Figure 12:
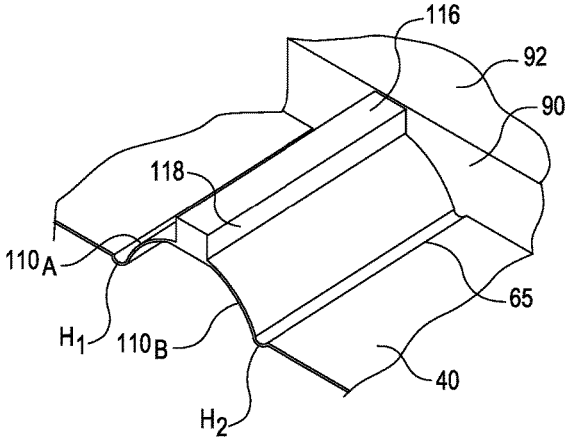
FIG. 12 is a perspective view of portions of an embodiment for a drink-through lid, now showing features which may be additionally provided in embodiment for a drink-through lid similar to that just shown in FIG. 11, now further illustrating the use of a stiffener located on the flexible structure curved surface, and wherein the stiffener is provided having a generally parallelepiped outer surface shape, which may in an embodiment be in the form of surface portions which may be provided by a rectangular parallepiped.

Attention is directed to FIGS. 11 through 16, wherein various details for alternate embodiments for lids are provided. In FIG. 11, the use of a curved panel 110 to provide a flexible structure 112 is illustrated. Hinges $H_1$ and $H_2$ are located between the floor 41 of the drink well base 40 and the curved panel 110 in this lid 114. FIG. 12 is a partial view of a variant of lid 114, wherein a stiffener 116 is utilized on the curved panel 110 of the flexible structure 112, or as illustrated, using a plurality of curved panels 110A and 110B. The stiffener 116 is provided having a generally parallelepiped outer surface shape, which may in an embodiment be in the form of surface portions 118 that would be provided by a rectangular parallepiped.

Figure 13:
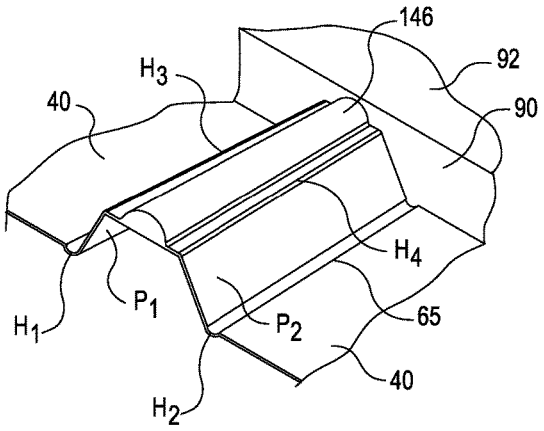
FIG. 13 is a perspective view of portions of an embodiment for a drink-through lid, now showing an embodiment for a stiffener located on the upper surface of the flexible structure, and wherein the stiffener is provided having a generally upwardly curved outer surface shape, which in an embodiment may be a partial cylindrical shaped surface of constant radius, or may alternately be an elliptically shaped surface portion, or may be some other curved surface shape generally rising above the upper surface of the flexible structure.
Figure 14:
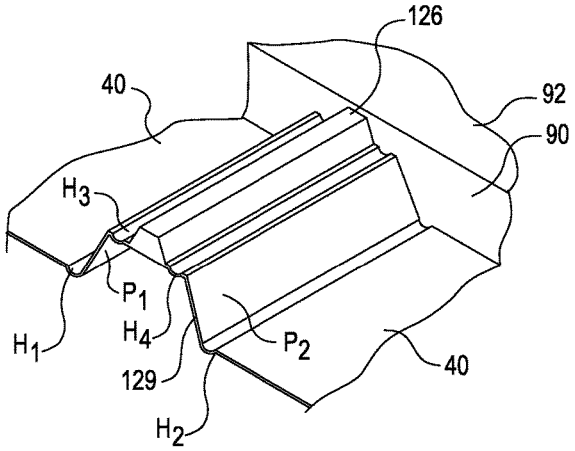
FIG. 14 is a perspective view of portions of an embodiment for a drink-through lid, now showing an embodiment of a stiffener located on the flexible structure, wherein the stiffener is provided having a generally trapezoidal prism outer surface shape, which may in an embodiment be in the form of an isosceles shaped trapezoidal prism.
Figure 28:
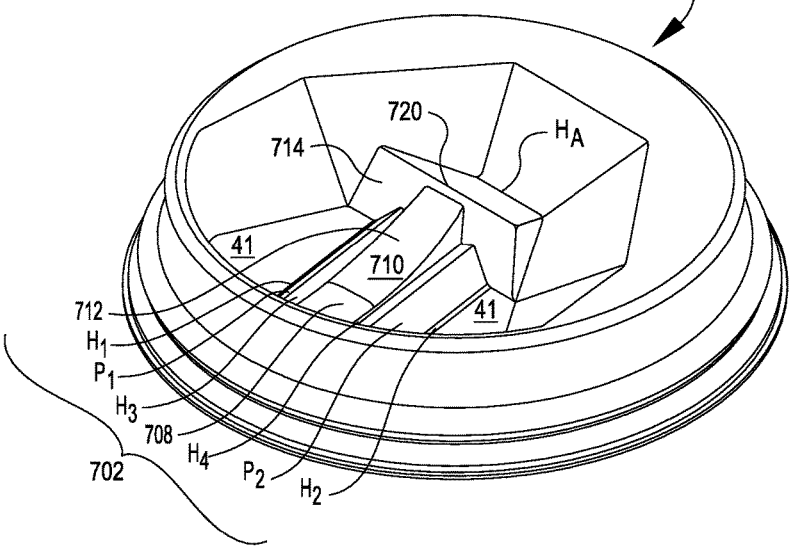
FIG. 28 provides a perspective view of still another embodiment for a drink-through lid, wherein an embodiment for a flexible structure is provided with a stiffener having an upper surface which has an upwardly sloping ramp which joins an actuator.
Figure 29:
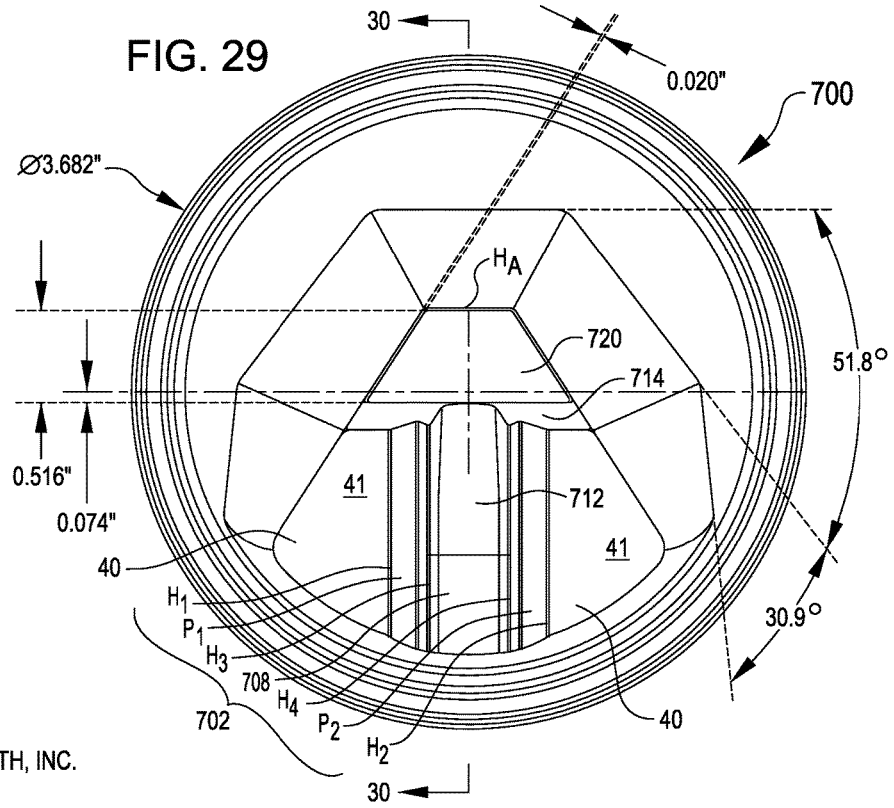
FIG. 29 provides a top plan view of the embodiment just shown in FIG. 28, showing a drink-through lid wherein an embodiment for a flexible structure is provided with a stiffener having an upper surface has an upwardly sloping ramp which joins an actuator.
Figure 30:
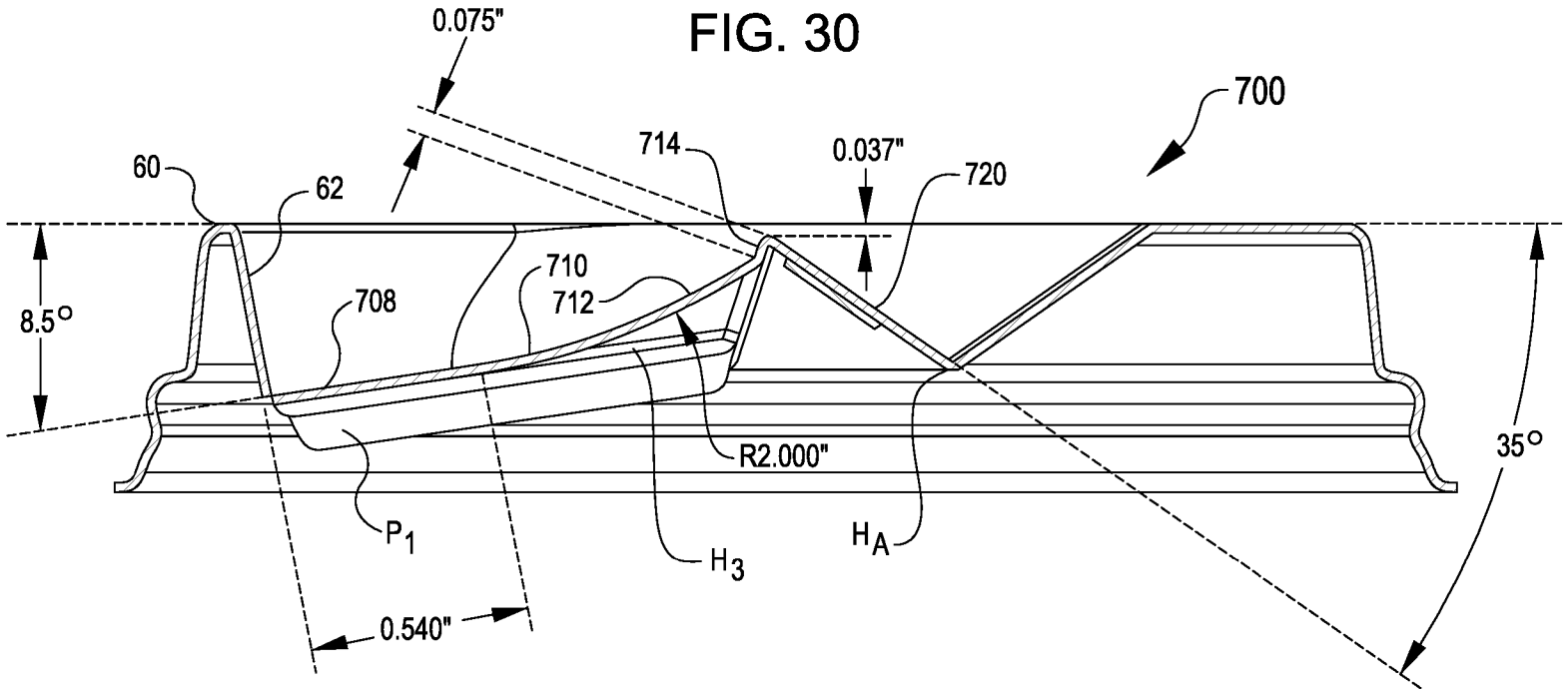
FIG. 30 provides a cross-sectional view of the embodiment just provided in FIGS. 28 and 29, taken across line 30-30 of FIG. 29, showing a drink-through lid wherein an embodiment for a flexible structure is provided with a stiffener having an upper surface has an upwardly sloping ramp which joins an actuator.

As seen in FIGS. 12 and 13, in an embodiment, the plurality of hinges may include a first hinge Hi between a first one $P_1$ of the plurality of panels and the floor 41 of the drink well base 40. In an embodiment, the plurality of hinges may include a second hinge $H_2$ between a second one $P_2$ of the plurality of panels and the floor 41 of the drink well base 40. As seen in FIG. 14, in an embodiment, the plurality of hinges may include a third hinge $H_3$ between a first one $P_1$ of the plurality of panels and a stiffener 126. The plurality of hinges may include a fourth hinge $H_4$ between a second one $P_2$ of the plurality of panels and a stiffener 126. In various embodiments, one or more of the plurality of hinges may be provided in the form of an elongated U-shaped hinge. In various embodiments, a stiffener (e.g. stiffener 116 or 126) may be provided as a rigid structure. In an embodiment (e.g. as seen in FIGS. 28, 29, and 30, further described herein below) the lid 30 may also include a stiffener rib which is located between the stiffener 74 and the outer face 90 of the actuator 92.

In various embodiments, the flexible structure 70 (or other flexible structures designated as such and described herein) and the drink well 63 may be integrally formed from common and connected components. In an embodiment, a flexible structure 70 and the drink well base 40 may be integrally formed and thus connected; in an embodiment they may be thermoformed components. In various embodiments, a flexible structure 70 may be provided in a generally convex shaped structure extending upward from the drink well base 40.

In various embodiments, a drink-through lid may be provided in which a plurality of panels are provided, a plurality of hinges are provided, and in which at least one stiffener is provided. In an embodiment, a stiffener, the plurality of hinges, and the plurality of panels are (a) sufficiently flexible so that the flexible structure (e.g. 70) is reversibly positionable between an upward, closed position (e.g. $\mathbf{70}_U$) and a downward, open position (e.g. $\mathbf{70}_D$) wherein a drink outlet 34 is provided in the interior portion 62 of the raised lip portion 54, yet (b) sufficiently stiff so that the flexible structure (e.g. 70) remains positioned at either an upward closed position or in a downward open position, when repositioned.

In an embodiment, as generally seen in FIGS. 1, 2, and 3, an actuator 92 may be utilized wherein a central wall 120 is provided in the lid 30. The central wall 120 may extend across at least a portion of the lid 30, and may have an actuator hinge $H_A$ which joins the central wall 120 with actuator 92. In an embodiment, a first lid sidewall 122 and a second lid sidewall 124 may be provided wherein each of the first 122 and second 124 lid sidewalls have an interior edge $\mathbf{122}_I$ and $\mathbf{124}_I$ respectively adjacent the central wall 120. Also, each of the first 122 and second 124 lid sidewalls have a bottom edge portion $\mathbf{122}_B$ and $\mathbf{124}_B$, respectively, and along the bottom edge portions $\mathbf{122}_B$ and $\mathbf{124}_B$ of the first and second lid sidewalls 122 and 124, a first slit ($S_5$ in FIG. 4) and a second slit ($S_{10}$ in FIG. 4), respectively. The actuator 92 may include an upper surface 128 and an outer face 90.

Figure 4A:
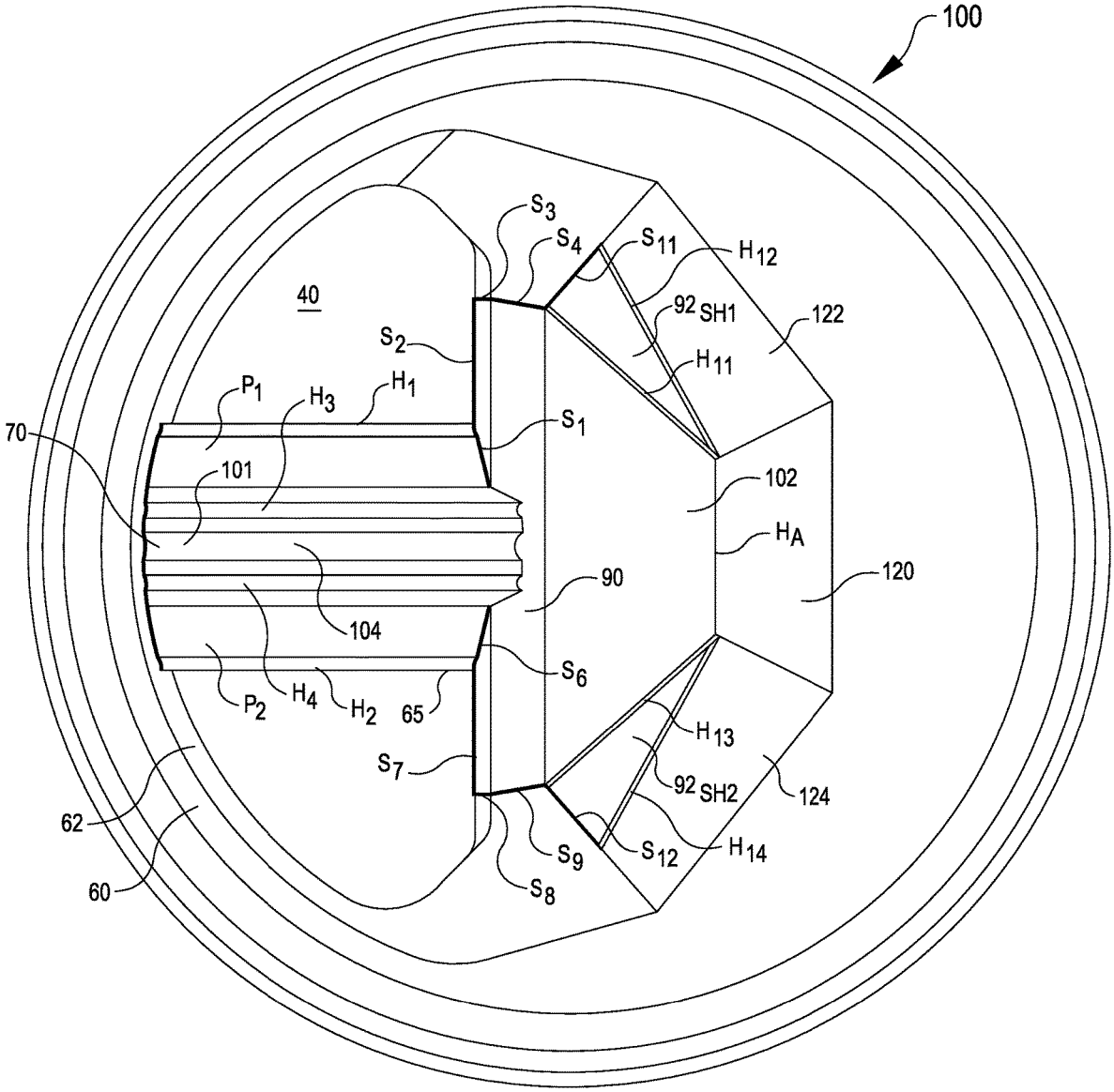
FIG. 4A is a plan view of an embodiment for a drink-through lid for a beverage container, similar to the embodiment shown in FIG. 4, but now showing the use of an actuator which preferentially utilizes hinges (shown using double lines) rather than slits (shown in heavy dark lines), between the lid and portions of the actuator; by using hinges, the lid may also be reversibly positioned between a drink outlet closed position and a drink outlet open position.

In an embodiment, the upper surface 128 of the actuator 92 may be trapezoidal in shape. In various embodiments where silts are utilized (e.g. slits $S_5$ and $S_{10}$), the actuator 92 may further include a first actuator sidewall $\mathbf{92}_{S1}$ and a second actuator sidewall $\mathbf{92}_{S2}$, which may be triangular in shape as is shown for second actuator sidewall $\mathbf{92}_{S2}$ in FIGS. 2 and 11. The first actuator sidewall $\mathbf{92}_{S1}$ may be provided in a similar or mirror image shape to second actuator sidewall $\mathbf{92}_{S2}$. In other embodiments where hinges are utilized (e.g. hinges $H_{11}$ and $H_{12}$, as well as hinges $H_{13}$ and $H_{14}$, as seen in FIG. 4A), the actuator 92 may further include a third actuator sidewall $\mathbf{92}_{SH1}$ and a fourth actuator sidewall $\mathbf{92}_{SH2}$, which may be triangular in shape as is shown for third actuator sidewall $\mathbf{92}_{SH1}$ and for fourth actuator sidewall $\mathbf{92}_{SH2}$ in FIG. 4A. In various embodiments using hinges, the first hinge $H_{11}$ between the first lid sidewall 122 and the first actuator sidewall $\mathbf{92}_{S1}$, and the second hinge $H_{13}$ between the second lid sidewall 124 and the second actuator sidewall $\mathbf{92}_{S2}$, are oriented so that the flexible structure 70, including the stiffener (101 in FIG. 4A), extends horizontally outward, and vertically downward, when the flexible structure 70 is configured in the downward, drink outlet open position, as show in detail in FIG. 24. In such a configuration, the outer face 304 of the flexible structure (302A' in FIG. 24) is displaced outward a distance D when the flexible structure 302 is in the downwardly shaped flexible structure, drink outlet open position, indicated in FIG. 24 as flexible structure 302A'.

In various embodiments, the flexible structure 70 extends across the drink well base 40 floor 41 from the interior portion 62 of the raised lip portion 54 to the outer face 90 of actuator 92. The flexible structure 70 may include a plurality of panels, and a plurality of hinges, and a stiffener 74 extending outward from the outer face 90 of the actuator 92. In an embodiment, the flexible structure 70 is adjustably positionable by pivotable movement of the actuator 92 at the actuator hinge $H_A$, so that the flexible structure 70 is positionable from an upwardly shaped structure 70u to a downwardly shaped structure $\mathbf{70}_D$. When the flexible structure 70 is positioned to the downwardly shaped structure $\mathbf{70}_D$, drink outlet 34 is defined in part by upper edge wall 33 and in part by the outer end $\mathbf{70}_0$ of the flexible structure 70, as seen in FIG. 3.

In FIG. 14, a flexible structure 129 may be provided. The flexible structure 129 may include a first stiffener hinge $H_3$ located between a stiffener (e.g. stiffener 126) and a first one (e.g. $P_1$) of a plurality of panels. In an embodiment the first stiffener hinge $H_3$ may be provided as an elongated U-shaped hinge. Likewise, a second stiffener hinge $H_4$ may be located between a stiffener (e.g. stiffener 126) and a second one (e.g. $P_2$) of a plurality of panels. In an embodiment the second stiffener hinge $H_4$ may be provided as an elongated U-shaped hinge.

As illustrated in FIG. 10, in an embodiment, a drink-through lid 30 may be configured so that the outer face 90 of an actuator 92 has a rearwardly sloping outer face 90 when the actuator is manipulated to place the flexible structure 70 into a downwardly shaped structure 70D. In this configuration, the rearwardly sloping outward face 90 provides a manually engageble surface (e.g. by finger 96 shown in FIG. 10) enabling positioning of the flexible structure 70 from an open position $\mathbf{70}_D$ to a closed position $\mathbf{70}_U$, as described above.

Figure 15:
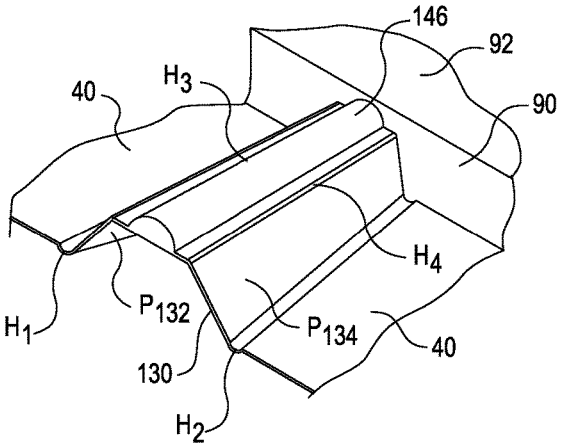
FIG. 15 is a perspective view of portions of an embodiment for a drink-through lid, now showing a stiffener as set out in FIG. 13 above, but now further illustrating an embodiment where sloping side panels in the flexible structure are provided, at least in part, as non-rectangular quadrilaterals, which may be where there are only two parallel sides, or in the form of a trapezium, with no parallel sides in the sloping side panels, or which may include a curved outer end (not shown in this FIG. 15 but easily understood by reference to FIG. 4 above) to match the shape of the slope and curvature of the interior portion of the raised lip portion of the drink-through lid.

As illustrated in FIG. 15, additional features may be utilized in various designs for a flexible structure 130 in a lid. For example, sloping side panels $P_{132}$ and $P_{134}$ in the flexible structure 130 are provided, at least in part, as non-rectangular quadrilaterals, which may be where there are only two parallel sides, or in the form of a trapezium, with no parallel sides in the sloping side panels, or which may include a curved outer end (not shown in this FIG. 15 but easily understood by reference to reference numeral $\mathbf{70}_0$ in FIG. 4 above) to match the shape of the slope and curvature of the interior portion of the raised lip portion of the drink-through lid. Hinges $H_1$, $H_2$, $H_3$, and $H_4$ are provided in the flexible structure 130 to join components in a manner already described herein for similar flexible structures.

Figure 16:
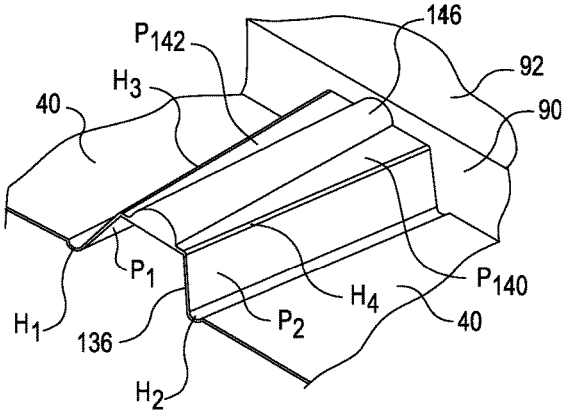
FIG. 16 is a perspective view of portions of an embodiment for a drink-through lid, now showing features which may be additionally provided in embodiment for a drink-through lid somewhat similar to that just shown in FIG. 16 above, but now further illustrating an embodiment where the generally horizontal top panel of the flexible structure may be provided, at least in part, as non-rectangular quadrilateral, which may have are only two parallel sides (e.g. having parallel inner and outer ends) or in which the which may include a curved outer end (not shown in this FIG. 16 but easily understood by reference to FIG. 4 above) to match the shape of the slope and curvature of the interior portion of the raised lip portion of the drink-through lid.

Yet further additional features are shown in FIG. 16 which provides a perspective view of portions of an embodiment for a drink-through lid. This FIG. 16 illustrates an embodiment where the generally horizontal top panels $P_{140}$ an $P_{142}$ of a flexible structure 136 may be provided, at least in part, as non-rectangular quadrilateral, which may have are only two parallel sides (e.g. having parallel inner and outer ends) or in which the which may include a curved outer end (not shown in this FIG. 16 but easily understood by reference to FIG. 4 above) to match the shape of the slope and curvature of the interior portion 62 of the raised lip portion 54 of a drink-through lid. A stiffener 146 with a curved surface is also provided.

Figure 20:
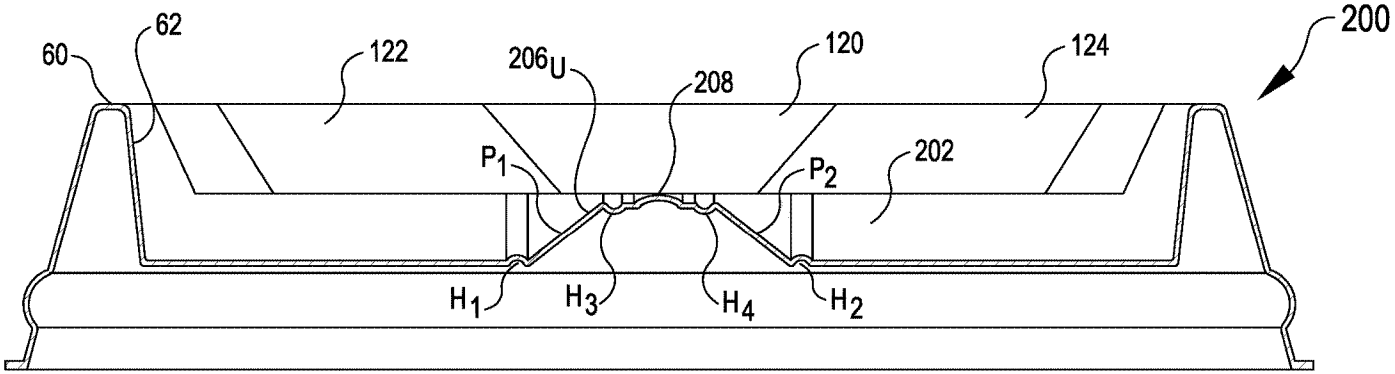
FIG. 20 is a cross-sectional view of the embodiment for a drink-through lid for a beverage container taken along line 20-20 of FIG. 18, showing a cross-sectional view of the flexible structure in an upward, drink outlet closed position, and showing location of first and second hinges between the drink well floor and the first and second side panels, respectively, and third and fourth hinges between the first and second side panels and a top panel, as well as the use of a stiffener on a top panel.
Figure 21:
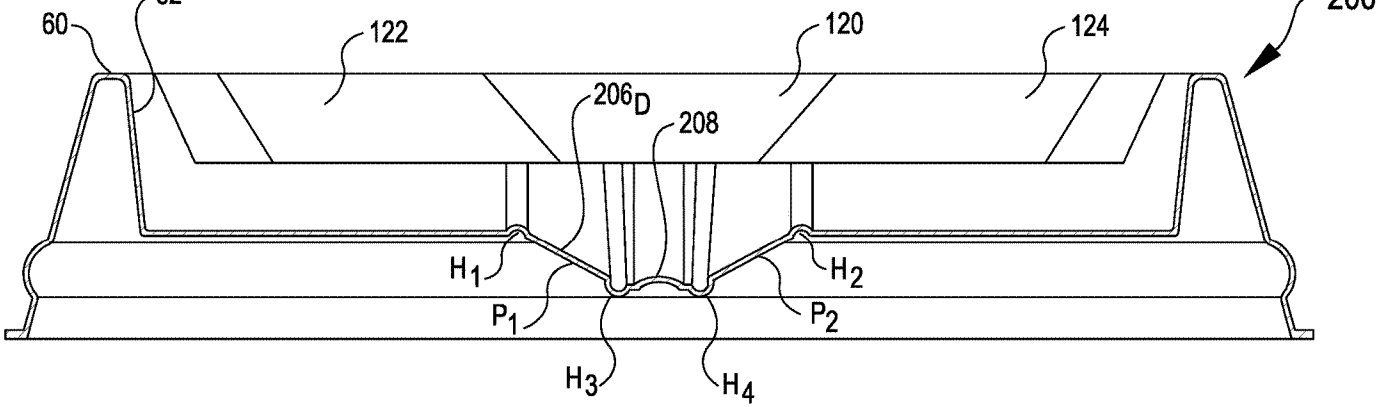
FIG. 21 is a cross-sectional view of the embodiment for a drink-through lid for a beverage container taken along line 21-21 of FIG. 19, showing a cross-sectional view of the flexible structure in a downward, drink outlet open position, and also showing location of first and second hinges between the drink well floor and the first and second side panels, respectively, and third and fourth hinges between the first and second side panels and a top panel, as well as the use of a stiffener on a top panel, all as may be located in the drink outlet open position.

Attention is now directed to FIGS. 17 through 21, where yet another embodiment for a drink-through lid 200 is provided. In this embodiment, no actuator (e.g. actuator 92 as noted in FIG. 1) is provided. Rather, a fixed internal wall 202 runs across the lid 200, and against which the interior end 204 of a flexible structure 206 is configured. The components of flexible structure 206 are noted in FIGS. 18 as $\mathbf{206}_U$, indicating that flexible structure 206 is in the upward, drink opening 34 closed condition. FIG. 20, taken as a cross-section across line 20-20- of FIG. 18, also shows flexible structure $\mathbf{206}_U$ in an upward drink opening condition. However, in FIG. 21 taken as a cross section across line 21-21 of FIG. 19, the same components of flexible structure 206 are noted as flexible structure $\mathbf{206}_D$, indicating that flexible structure 206 is in the downward, drink opening 34 open condition. Flexible structure 206 may include panel $P_1$ and hinge $H_1$, and panel $P_2$ and hinge $H_2$, as well as s centrally located stiffener 208. Generally, the location of a drink outlet 34 and the functionality of the flexible structure 206 are as described above with respect to flexible structure 70. Note that an outer end 210 of flexible structure 206 defines the lower portion of the drink outlet 34, and that the upper edge wall 33 in interior portion 62 defines the upper portion of drink outlet 34.

Figure 17:
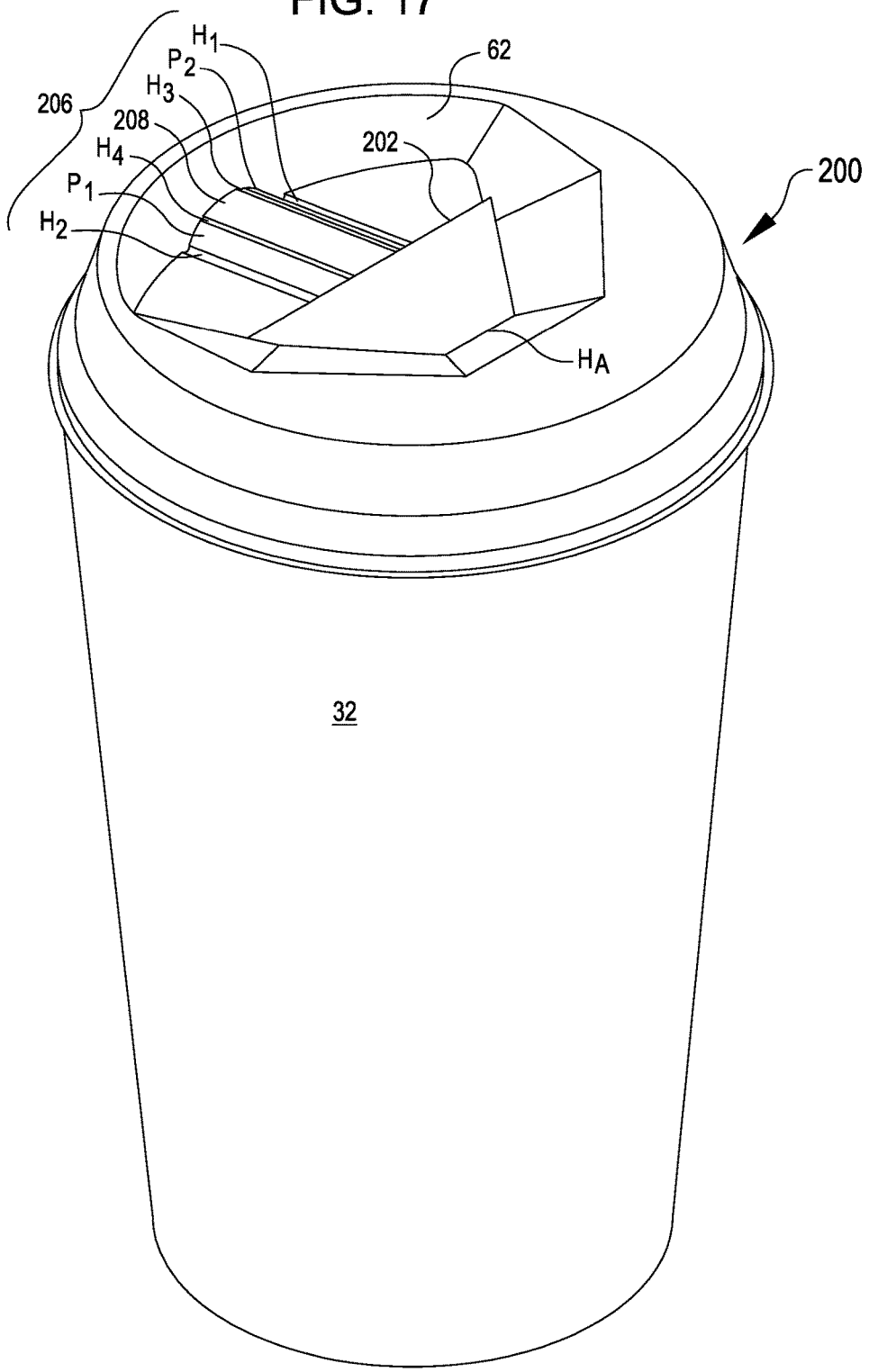
FIG. 17 is a perspective view of another embodiment for a drink-through lid for a beverage container, somewhat similar to that first illustrated in FIG. 1, but unlike the embodiment of FIG. 1 lacks an actuator, but still includes a drink well base into which liquid emerges for consumption, and which includes a flexible structure extending inward from the interior portion of the raised lip portion to an outward face of an interior wall in the lid.
Figure 18:
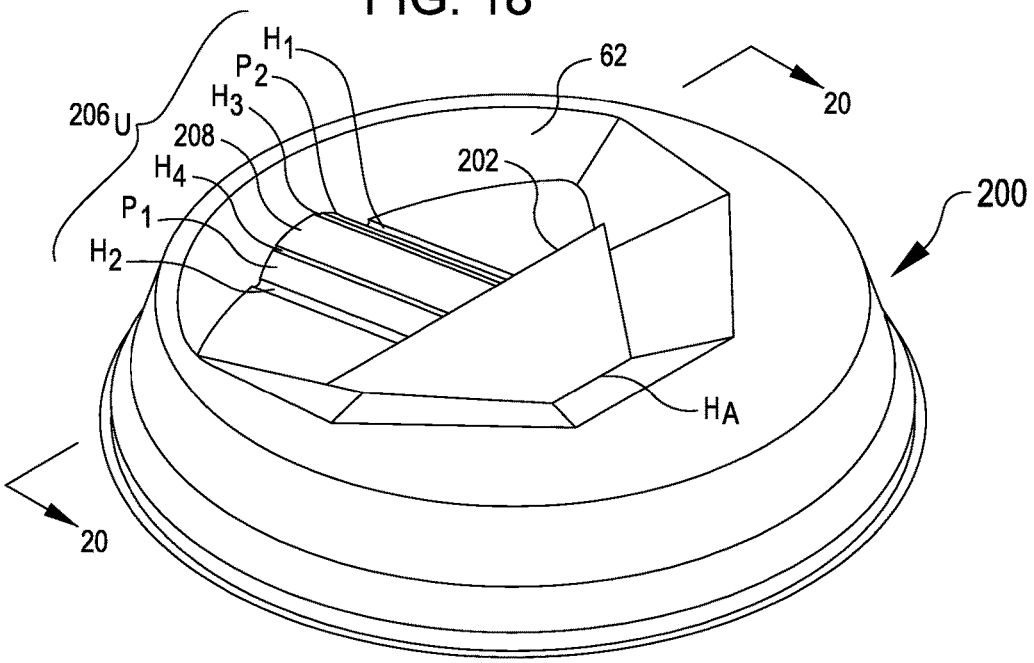
FIG. 18 is a perspective view of the embodiment for a drink-through lid for a beverage container as just shown in FIG. 17 above, showing the flexible structure in an upward, closed position, wherein the outer end of the flexible structure maintains closure of a liquid outlet in the interior portion of the raised lip portion of the drink-through lid.
Figure 19:
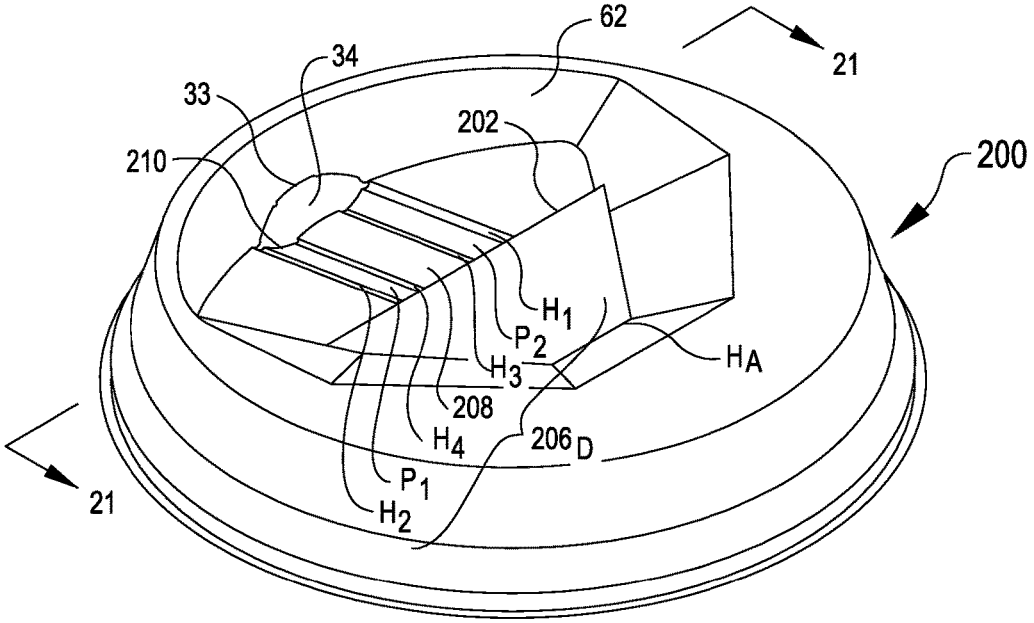
FIG. 19 is a perspective view of the embodiment for a drink-through lid for a beverage container as just shown in FIGS. 17 and 18 above, but now showing the flexible structure in a downward, open position, wherein the outer end of the flexible structure in the downward position exposes upper edge portions of the drink outlet in the interior portion of the raised lip portion of the drink-through lid, and defines lower edge portions of the drink outlet.
Figure 22:
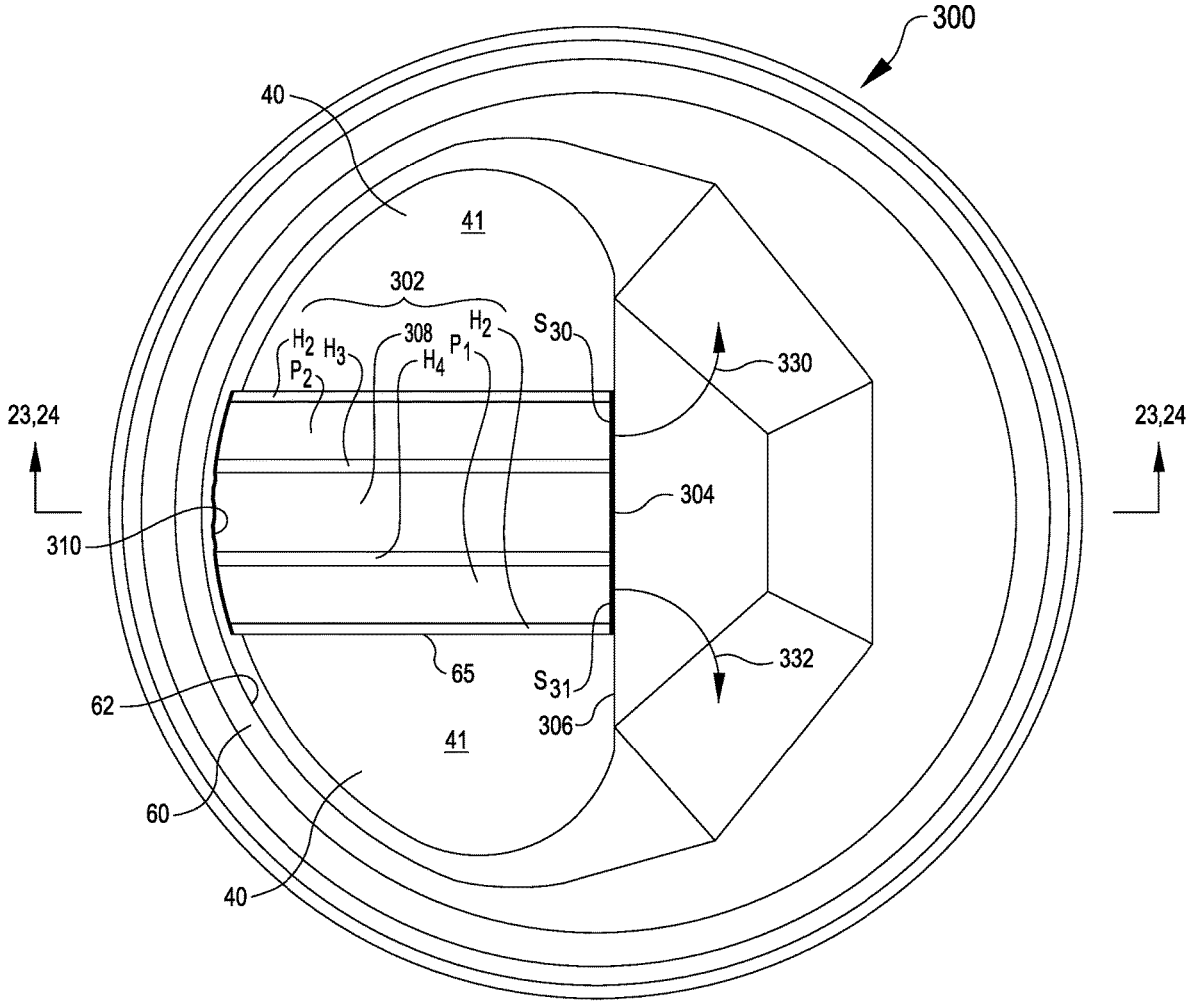
FIG. 22 provides a top plan view of yet another embodiment for a drink-through lid for a beverage container, now showing an embodiment without a separate actuator, but where the flexible structure extends from the interior portion of the raised lip portion of the drink-through lid inward to an outward face of an interior wall in the lid, rather similar to the structure first shown in FIG. 17 above.

FIG. 22 provides a top plan view of yet another embodiment for a drink-through lid 300 for a beverage container, now showing an embodiment without a separate actuator, but where a flexible structure 302 extends from the interior portion 62 of the raised lip portion 54 of the drink-through lid 300 inward to an outer face 304 of a fixed interior wall 306 in the lid 300, rather similar to the structure first shown in FIG. 17 above. Flexible structure 302 may include panel $P_1$ and hinge $H_1$, and panel $P_2$ and hinge $H_2$, as well as s centrally located stiffener 308. Similarly, hinge $H_3$ connects panel $P_2$ and stiffener 308, and hinge $H_4$ connects panel $P_1$ with stiffener 308. Generally, the location of a drink outlet 34 (see FIG. 23) and the functionality of the flexible structure 302 are as described above with respect to flexible structure 70. Note that an outer end 310 of flexible structure 302 (reference numeral 310 when in the upper, closed position but as reference numeral 310' when placed in the downward, open position by movement as indicated by reference arrow 312) defines the lower portion of the drink outlet 34 (see FIG. 24), and that the upper edge wall 33 in interior portion 62 defines the upper edge of drink outlet 34. Also, when flexible structure 70 is placed in a downward, drink outlet open position, slit $S_{30}$ provides a vent opening for outward movement of vapors as indicated by reference arrow 330. Likewise, slit $S_{31}$ provides a vent opening for outward movement of vapors as indicated by reference arrow 332.

Figure 23:
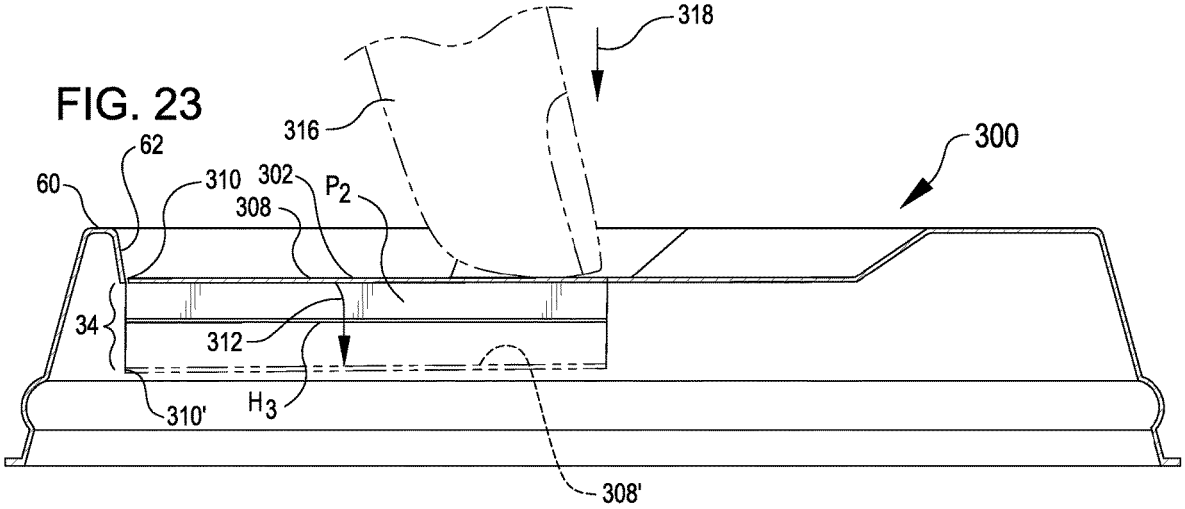
FIG. 23 is a cross-sectional view of an embodiment for a drink-through lid for a beverage container taken as if along line 23-23 of FIG. 22, showing a cross-sectional view—in solid cross-sectional lines—the flexible structure in an upward, drink outlet closed position, and the showing location the flexible structure when it is pressed downward at the stiffener such as by the finger shown, to place the flexible structure into a downward, drink outlet open position—shown in broken lines.

In an embodiment, a flexible structure 302 may be oriented substantially horizontally, as is illustrated in FIG. 23, which provides a cross-sectional view. FIG. 23 shows in solid cross-sectional lines the flexible structure 302 in an upward, drink outlet closed position, and the shows location the flexible structure 302 when it is pressed downward at the stiffener 308 such as by the finger 316 in the direction of reference arrow 318 as shown, to place the flexible structure into a downward, drink outlet open position, which is shown in broken lines.

Figure 24:
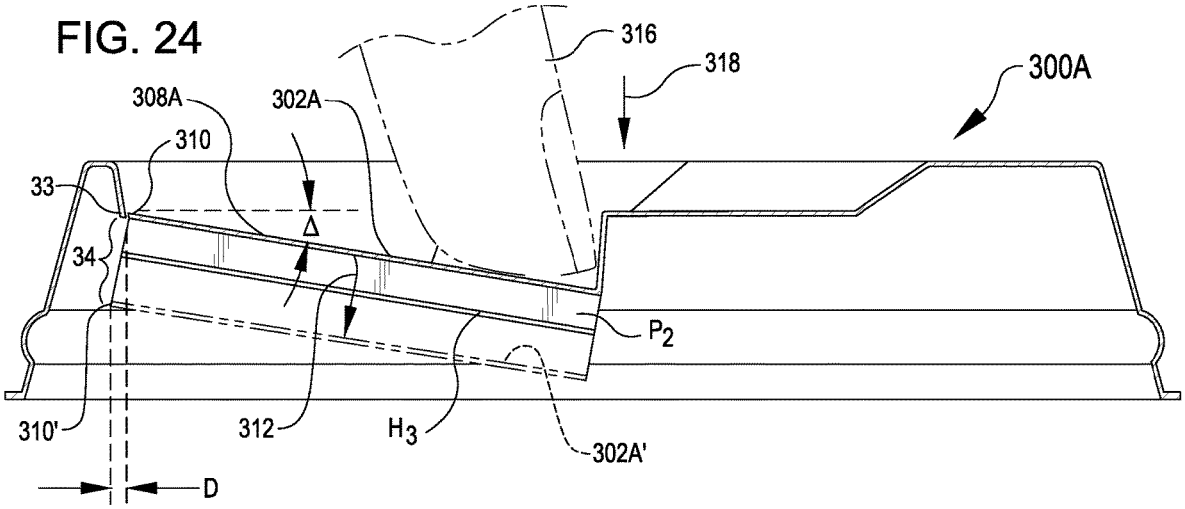
FIG. 24 is a cross-sectional view of a further variation for an embodiment for a drink-through lid for a beverage container taken as if along line 24-24 of FIG. 22, but now showing the use of an inward slope at an angle delta (Δ) in the flexible structure, showing in the cross-sectional view in solid cross-sectional lines the flexible structure in an upward, drink outlet closed position, and then also showing location the flexible structure when it is pressed downward at the stiffener such as by the finger as shown, to place the flexible structure into a downward, drink outlet open position—shown in broken lines, and in particular illustrating how by orienting the flexible structure so that it slopes inwardly and downwardly, the flexible structure (when in the downward drink outlet open position) effectively prevents splash of liquid outward through a drink outlet.

In yet another embodiment, having a plan view as was illustrated in FIG. 22, but having a different cross sectional view, FIG. 24 shows a further variation for an embodiment for a drink-through lid 300A, taken as if along line 24-24 of FIG. 22, but now showing the use of an inward slope at an angle delta (Δ) in a flexible structure 302A. Also shown in the cross-sectional view in solid cross-sectional lines is flexible structure 302A in an upward, drink outlet closed position. Then, the flexible structure 302A is shown having been pressed downward at the stiffener 308A such as by the finger 316 as shown, to place the flexible structure designated as 302A' into a downward, drink outlet open position, shown in broken lines. This FIG. 24 illustrates how, by orienting the flexible structure 302A so that it slopes inwardly and downwardly, the flexible structure 302A (when in the downward drink outlet open position), the outer end 310 of the flexible structure 302A moves outward a distance D, thus effectively preventing splash of liquid outward through a drink outlet 34.

Figure 25:
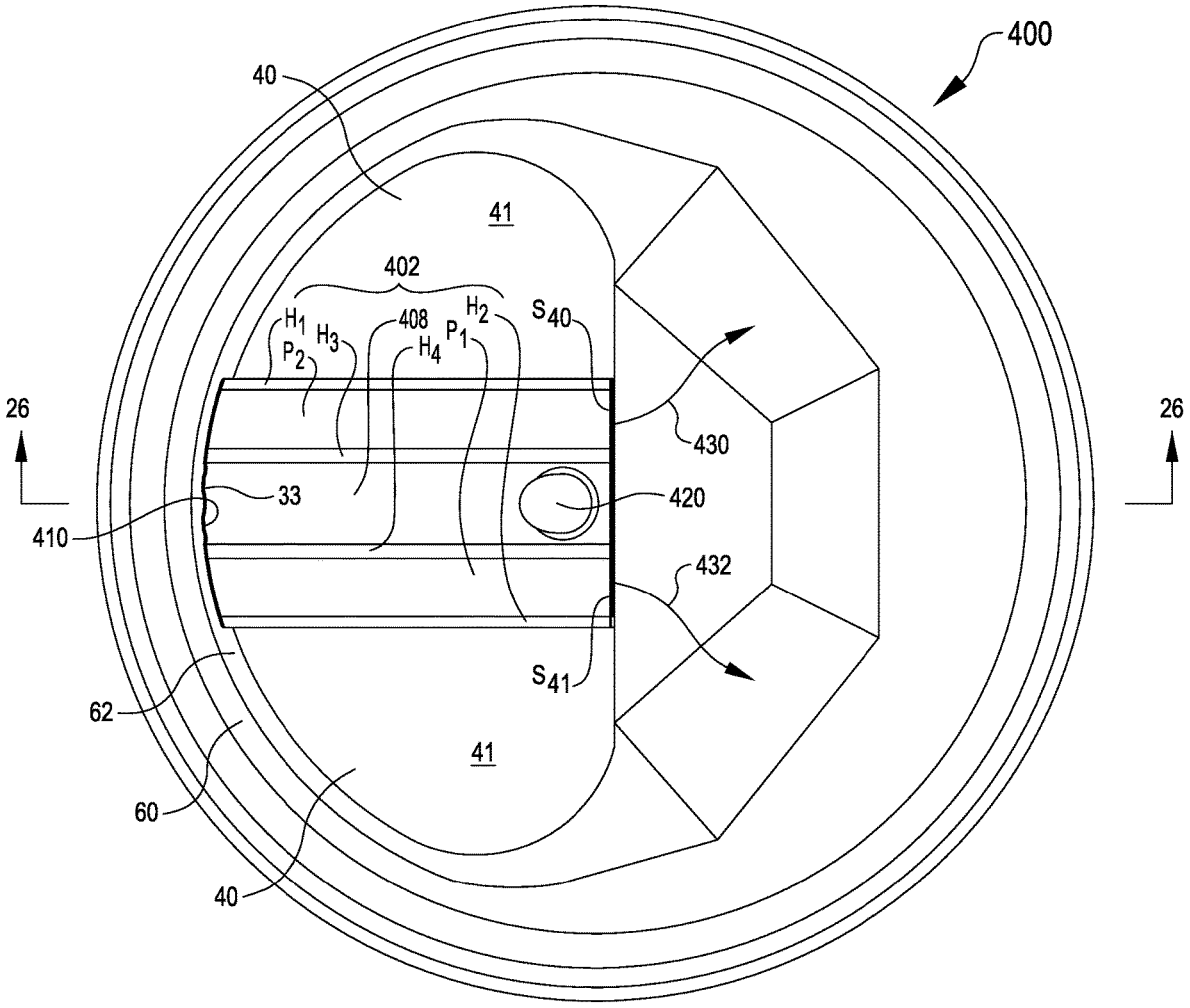
FIG. 25 provides a top plan view of yet another embodiment for a drink-through lid for a beverage container, again showing an embodiment without a separate actuator (similar to the embodiment illustrated in FIG. 22 above), but now also showing the addition of a contact surface which extends upwardly from a centrally located stiffener.
Figure 26:
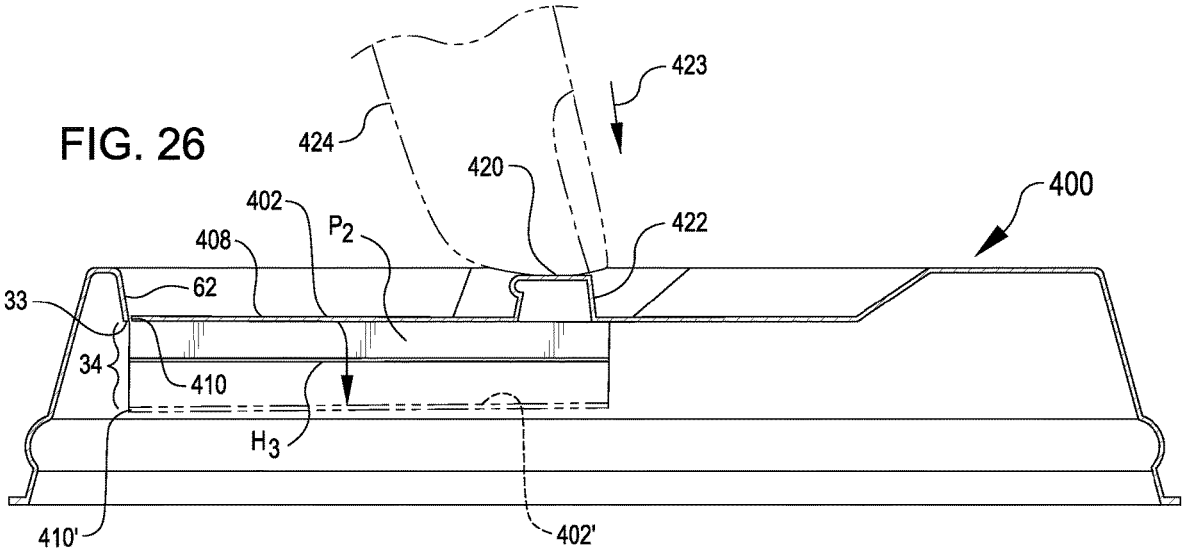
FIG. 26 provides a cross-sectional view, taken through section 26-26 of FIG. 25, to further illustrate an embodiment for a drink-through lid which utilizes a contact surface which extends upwardly from a centrally located stiffener, and in which downward pressure against the contact surface such as by use of a finger as illustrated will move the flexible structure from an upward, drink outlet closed position to a downward, drink outlet open position.

FIG. 25 provides a top plan view of yet another embodiment for a drink-through lid 400 for a beverage container, again showing an embodiment without a separate actuator (similar to the embodiment illustrated in FIG. 22 above), but now also showing the addition of a contact surface 420 which extends upwardly from a centrally located stiffener 408. Note that an outer end 410 of flexible structure 402 defines a lower portion of the drink outlet 34, and that the upper edge wall 33 (not seen in FIG. 25 but similar as shown in FIG. 3 above, and as can be seen in FIG. 26) in interior portion 62 defines the upper portion of a drink outlet 34. Also, when flexible structure 402 is placed in a downward, drink outlet open position, slit $S_{40}$ provides a vent opening for outward movement of vapors as indicated by reference arrow 430. Likewise, slit $S_{41}$ provides a vent opening for outward movement of vapors as indicated by reference arrow 432.

FIG. 26 provides a cross-sectional view, taken through section 26-26 of FIG. 25, to further illustrate the embodiment for a drink-through lid 400 which utilizes a contact surface 420 which may extend upwardly from centrally located stiffener 408, via riser 422. Downward pressure as indicated by reference arrow 423 against the contact surface 420 such as by use of a finger 424 as illustrated will move the flexible structure 402 from an upward, drink outlet 34 closed position to a downward, drink outlet 34 open position, which is indicated by the position of flexible structure 402' in broken lines in FIG. 26, and the drink opening position of stiffener 408, indicated by reference numeral 408A'.

Figure 25A:
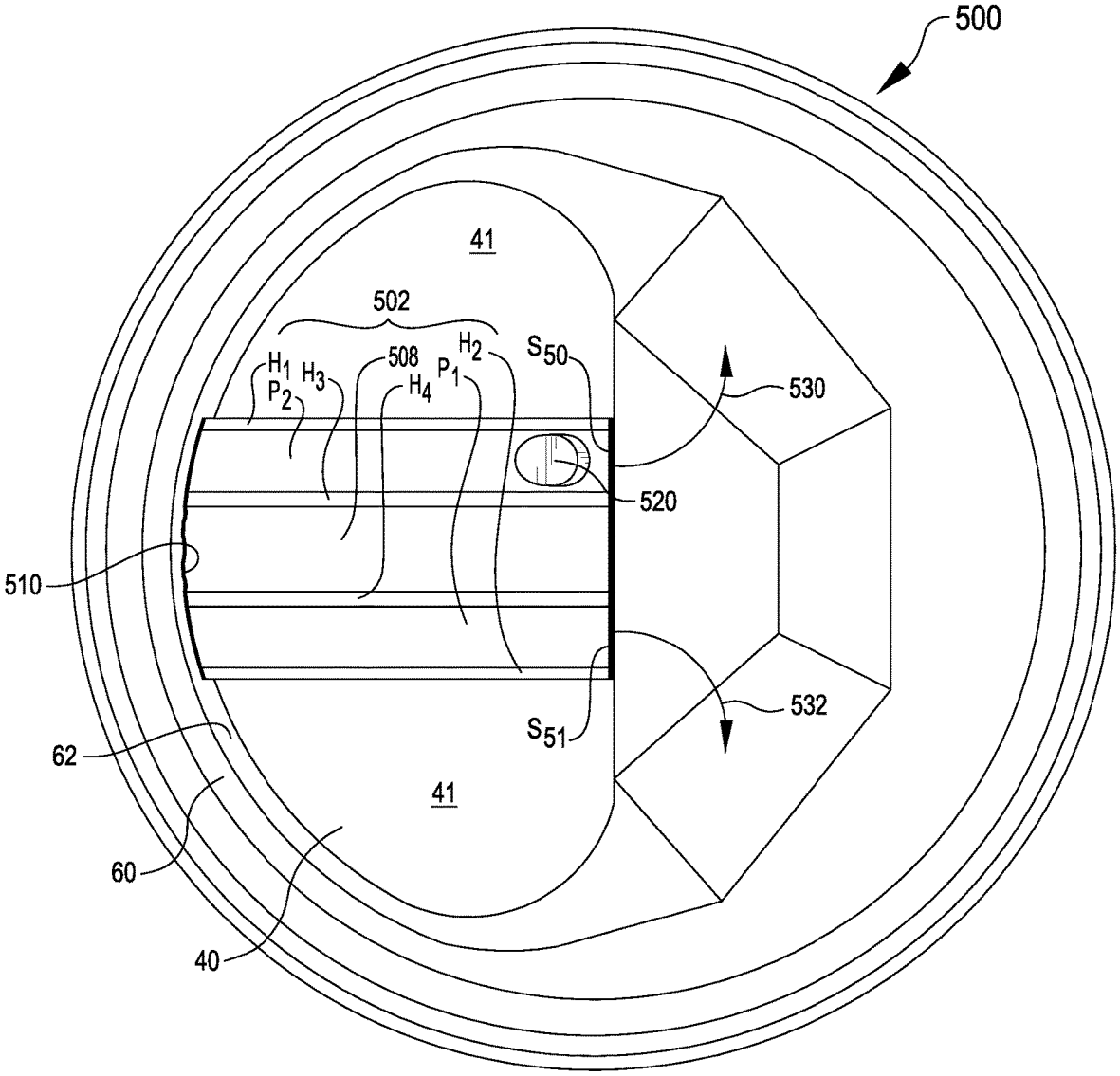
FIG. 25A provides a top plan view of yet another embodiment for a drink-through lid for a beverage container, again showing an embodiment without a separate actuator (similar to the embodiment illustrated in FIG. 22 above), but now showing the use of a contact surface which extends upwardly from one of the plurality of panels provided as a part of the flexible structure.

FIG. 25A provides a top plan view of yet another embodiment for a drink-through lid 500 for a beverage container, again showing an embodiment without a separate actuator (similar to the embodiment illustrated in FIG. 22 above), but now also showing the addition of a contact surface 520 on a side panel $P_2$, which extends upwardly from the side panel $P_2$. Note that an outer end 510 of flexible structure 502 defines a lower portion of the drink outlet 34 (generally as shown in the embodiment shown in FIG. 26 above for outer end 410')) and that the upper edge wall 33 (not seen in FIG. 25A but similar as shown in FIG. 26) in interior portion 62 defines the upper portion of a drink outlet 34. Also, when flexible structure 502 is placed in a downward, drink outlet 34 open position, slit $S_{50}$ provides a vent opening for outward movement of vapors as indicated by reference arrow 530. Likewise, slit $S_{51}$ provides a vent opening for outward movement of vapors as indicated by reference arrow 532. Downward pressure against the contact surface 520 (such as by use of a finger as illustrated in FIG. 26 above) will move the flexible structure 502 (including side panels $P_1$ and $P_2$, and stiffener 508, and interconnecting hinges $H_1$, $H_2$, $H_3$, and $H_4$) from an upward, drink outlet 34 closed position to a downward, drink outlet 34 open position.

Figure 27:
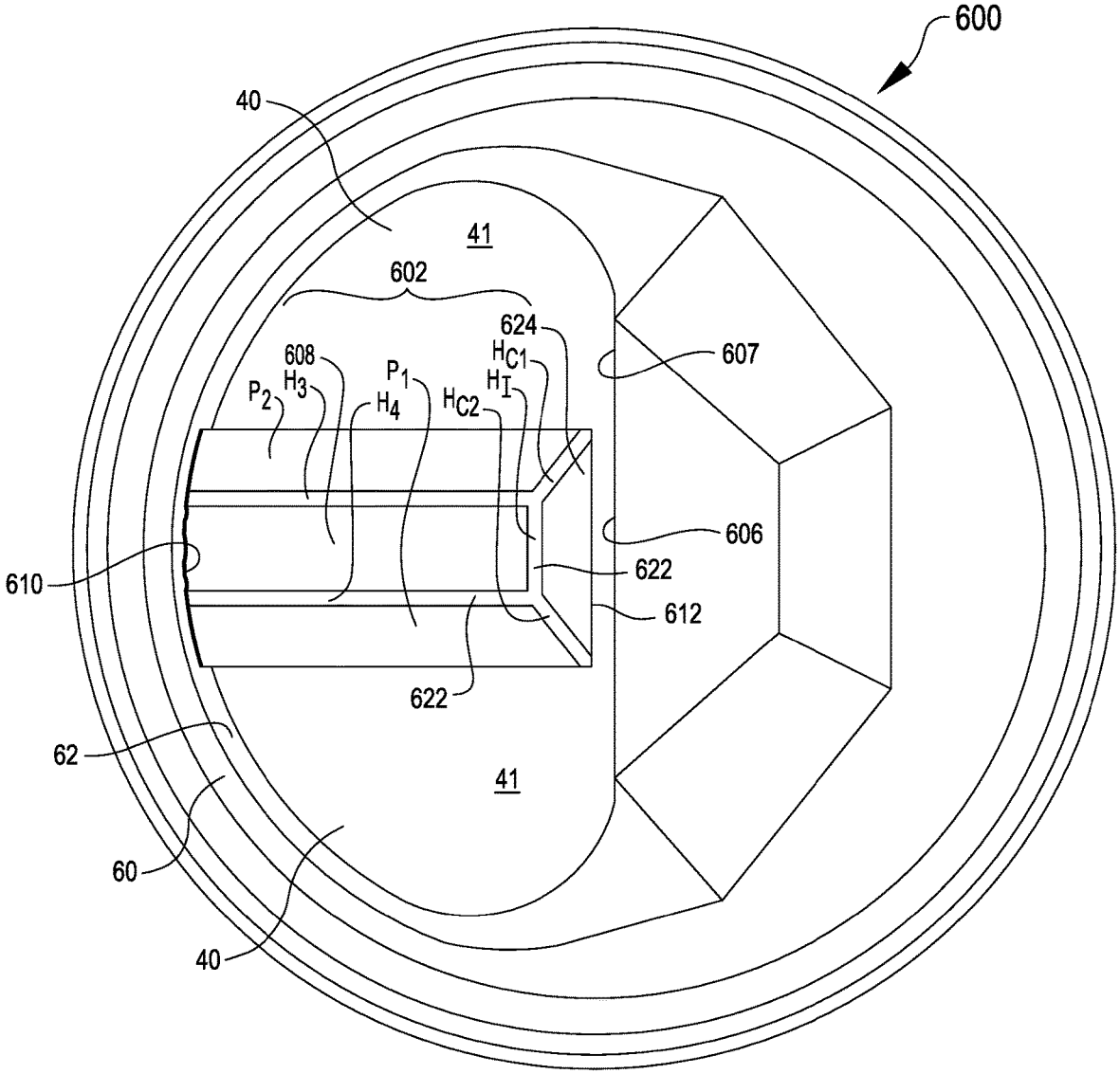
FIG. 27 provides a top plan view of still another embodiment for a drink-through lid for a beverage container, still showing in this embodiment a configuration which does not utilize a separate actuator, but which utilizes a flexible structure extending from the interior portion of the raised lip portion of the drink-through lid to an inward end, and wherein the inward end of the flexible structure is spaced apart and outwardly from the outward face of an interior wall in the lid, and wherein the flexible structure may utilize a stiffener which is offset outward from the inward end of the flexible structure, in which a first corner hinge and a second corner hinge are provided, and in which an inner hinge may also be provided between the inward end of the stiffener and an inner flexible panel, and as illustrated, where the inner flexible panel may be trapezoidal in shape.

FIG. 27 provides a top plan view of still another embodiment for a drink-through lid 600 for a beverage container 32. This embodiment for lid 600 provides a configuration which does not utilize a separate actuator, but which utilizes a flexible structure 602 extending from an outer end 610 adjacent the interior portion 62 of the raised lip portion of the drink-through lid 600 to an inward end 612. In this embodiment, the inward end 612 of the flexible structure 602 is spaced apart and outwardly from the outward face 606 of an interior wall 607 in the lid 600. The flexible structure 602 may utilize a stiffener 608 which is offset outward from the inward end 612 of the flexible structure 602. In an embodiment, stiffener 608 may be separated from panel $P_1$ by top hinge $H_4$. In an embodiment, stiffener 608 may be separated from panel $P_2$ by top hinge $H_3$. In an embodiment, a first corner hinge $H_{C1}$ and a second corner hinge $H_{C2}$ are provided, and an inner hinge $H_1$ may also be provided between the inward end 622 of the stiffener 608 and an inner flexible panel 624. As illustrated the inner flexible panel 624 may be trapezoidal in shape.

Attention is now directed to FIGS. 28, 29, and 30, in which the details of yet another embodiment for a drink-through lid 700 are provided. FIG. 28 provides a perspective view of a drink-through lid 700, wherein a flexible structure 702 is provided with a stiffener 708 having an upper surface 710 which includes a rib 712 which has an upwardly sloping ramp shape inward and upward to join the outer face 714 of an actuator 720.

As better seen in the top plan view provided in FIG. 29, in an embodiment lid 700 may include hinges $H_1$ and $H_2$ which are located between the drink well base 40 floor 41 and the panels $P_1$ and $P_2$, respectively, of flexible structure 702. Similar to embodiments described above, hinge $H_3$ may be provided between panel $P_1$ and stiffener 708. Likewise, hinge $H_4$ may be provided between panel $P_2$ and stiffener 708.

FIG. 30 provides a cross-sectional view of the embodiment for a lid 700 as just provided in FIGS. 28 and 29, taken across line 30-30 of FIG. 29, showing a drink-through lid 700 wherein the flexible structure 702 (see FIG. 29) is in an upwardly disposed configuration, thus providing a drink outlet 34 in a closed condition. The position of flexible structure 702, when changed to a drink outlet 34 open condition is not shown, but will easily be understood by those of skill in the art by reference to the descriptions herein above, particularly with reference to FIG. 3 and other like figures of the drawing. Additionally, FIGS. 29, and 30 provide various angles and distances between components of lid 700, which taken together with FIG. 28 and the other description provided elsewhere herein fully enable one of ordinary skill in the art to make and use an exemplary lid 700.

Figure 31:
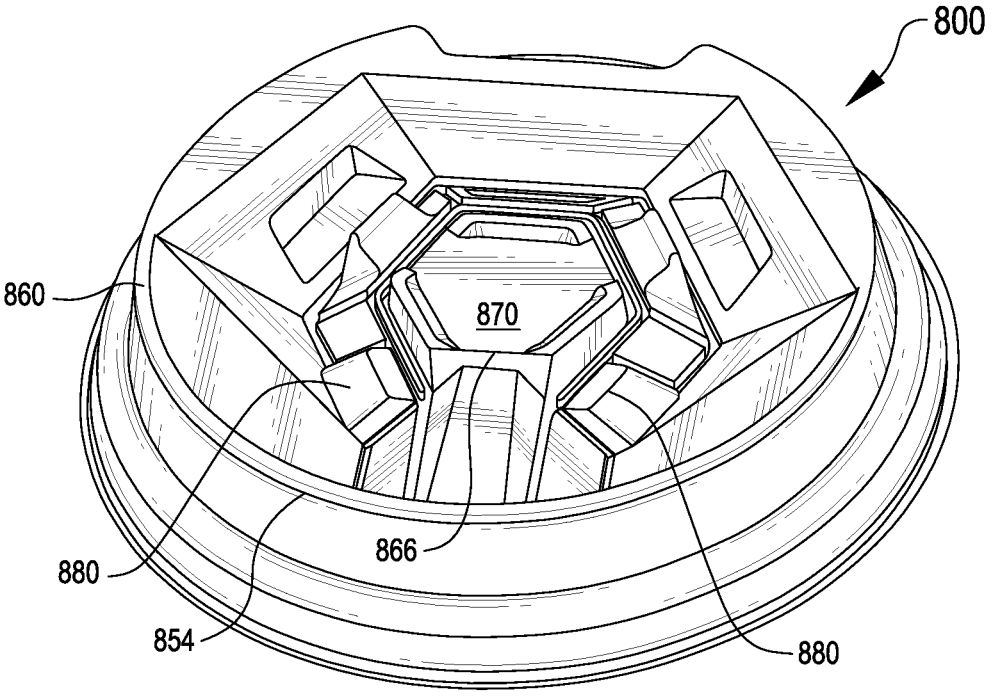
FIG. 31 provides a top perspective view, taken from the front, of still another embodiment for a drink-through lid for a beverage container which utilizes a flexible structure extending from the interior portion of the raised lip portion of the drink-through lid to an inward end, and wherein the inward end of the flexible structure is operatively coupled with an actuator, and wherein the actuator may be pressed by a user to move the flexible structures to a drink opening position, and wherein the actuator is operatively coupled to vent structures, so that when the actuator is pressed by a user to move the flexible structures to a drink opening position, the vent structures are also moved to an open position, to allow aroma vapors to escape the beverage container through the vent structures.
Figure 35:
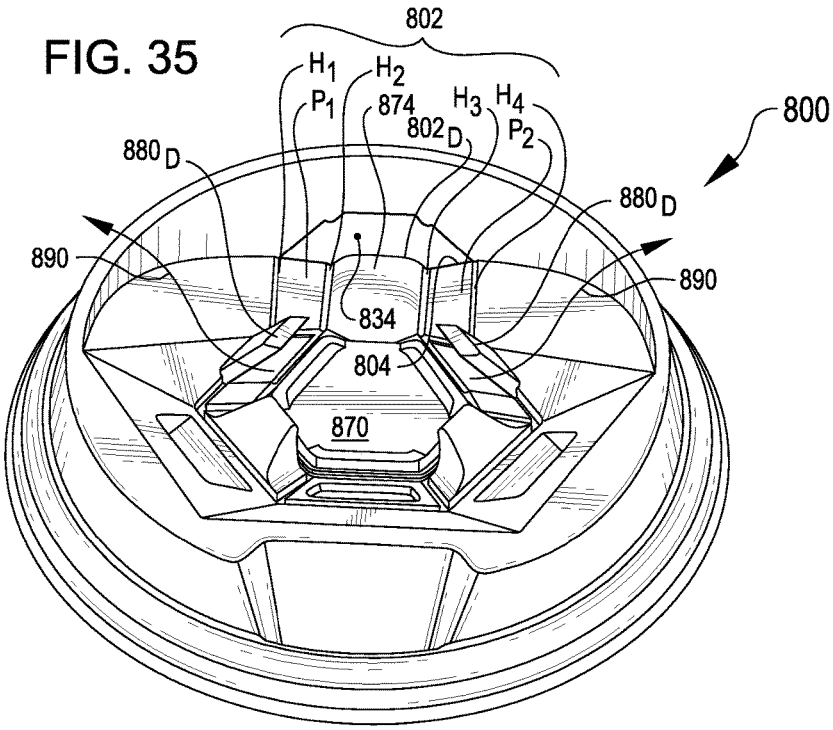
FIG. 35 is a top perspective view, taken from the back, of the lid just depicted in FIGS. 31-34 above, showing a drink-through lid for a beverage container which utilizes a flexible structure extending from the interior portion of the raised lip portion of the drink-through lid to an inward end, and wherein the inward end of the flexible structure is operatively coupled with an actuator, and wherein the actuator and flexible structure are depicted in a depressed, drink opening position, and where in the vent structures are open to allow vapors to pass therethrough.
Figure 36:
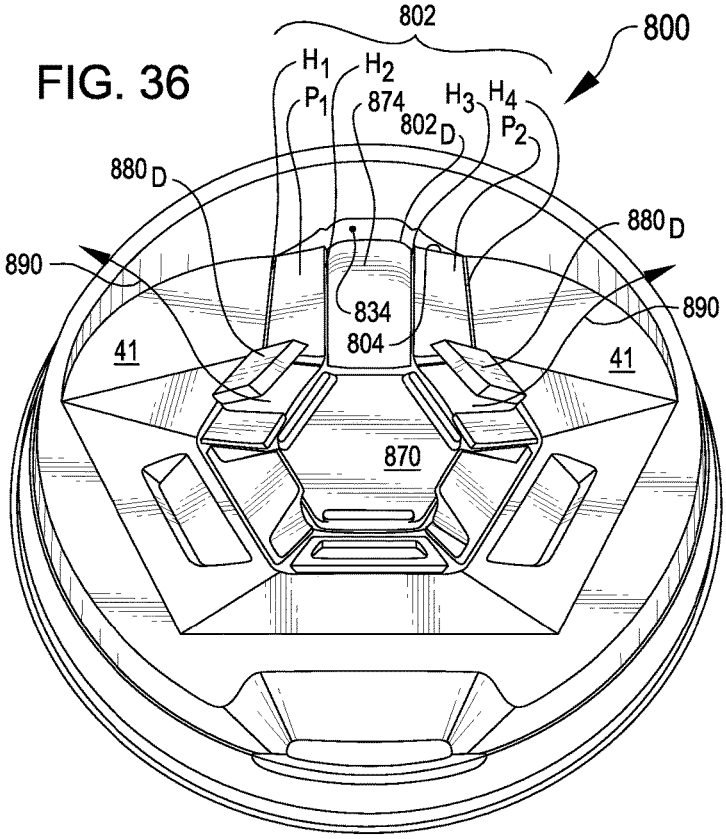
FIG. 36 is a top perspective view, taken from the back, of the lid as just depicted in FIG. 35 above, showing a drink-through lid for a beverage container which utilizes a flexible structure extending from the interior portion of the raised lip portion of the drink-through lid to an inward end, and wherein the inward end of the flexible structure is operatively coupled with an actuator, and wherein the actuator and flexible structure are depicted in a depressed, drink opening position, and where in the vent structures are open to allow vapors to pass therethrough.

Attention is directed to FIG. 31, which provides a top perspective view, taken from the front, of still another embodiment for a drink-through lid 800 for a beverage cup 32 which utilizes a flexible structure 802 extending from an outer end 804 at the interior portion 862 of the raised lip portion 854 of the drink-through lid 800 to an inward end 866, and wherein the inward end 866 of the flexible structure 802 is operatively coupled with an actuator 870. The actuator 870 may be pressed by a user to move the flexible structure 802 to a drink opening position 802D, as seen in FIGS. 35 and 36. Also, in an embodiment, the actuator 870 may be operatively coupled to vent structures 880, so that when the actuator 870 is pressed by a user to move the flexible structure 802 to a drink opening position 802D, the vent structures 880 are also moved to an open position $\mathbf{880}_O$ (see FIGS. 35 and 36), to allow aroma vapors as indicated by reference arrows 890 to escape a beverage cup 32 through the vent structures 880.

Figure 32:
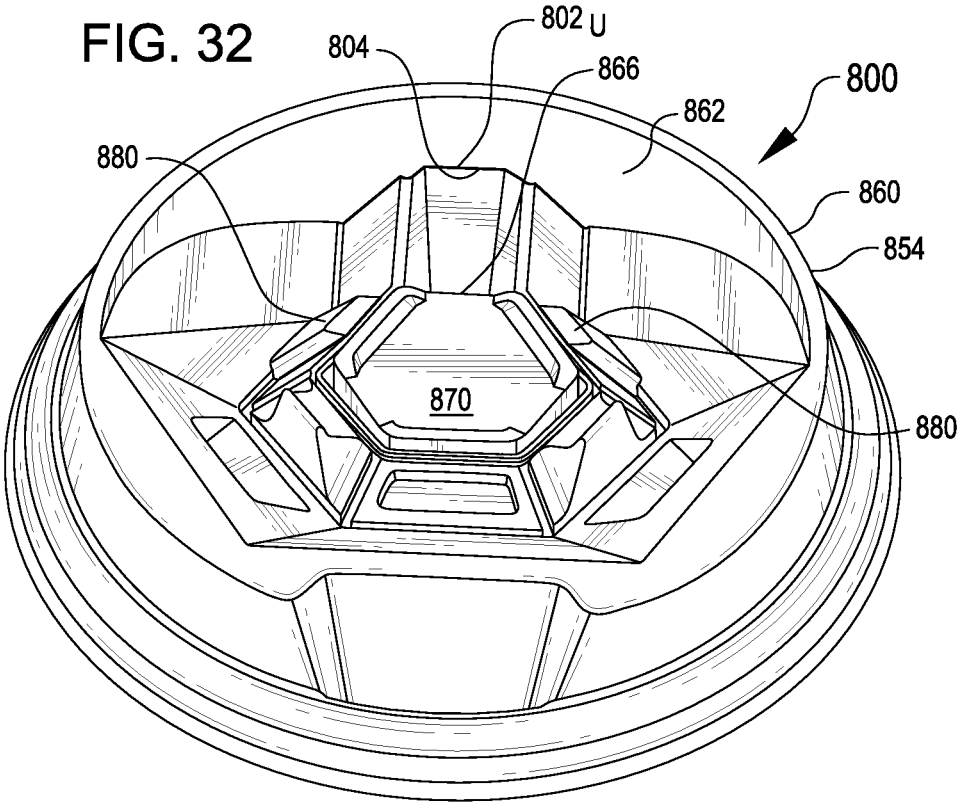
FIG. 32 provides a top perspective view, taken from the back, of the lid just depicted in FIG. 31 above, showing a drink-through lid for a beverage container which utilizes a flexible structure extending from the interior portion of the raised lip portion of the drink-through lid to an inward end, and wherein the inward end of the flexible structure is operatively coupled with an actuator, and wherein the actuator, when in the closed position, may be pressed by a user to move the flexible structures to a drink opening position (see FIGS. 35 and 36 below), and wherein the actuator is operatively coupled to vent structures, so that when the actuator is pressed by a user to move the flexible structures to a drink opening position, the vent structures are also moved to an open position, to allow aroma vapors to escape the beverage container through the vent structures.

FIG. 32 provides a top perspective view, taken from the back, of the lid 800 just depicted in FIG. 31 above, showing a drink-through lid for a beverage cup 32 which utilizes a flexible structure 802 extending from the interior portion 862 of the raised lip portion 864 of the drink-through lid 800 to an inward end 866. The inward end 866 of the flexible structure 802 is operatively coupled with an actuator 870. The actuator 870, when in the closed position, may be pressed by a user to move the flexible structure 802 to a drink opening position (see FIGS. 35 and 36 below). The actuator 870 is operatively coupled to vent structures 880, so that when the actuator 870 is pressed by a user to move the flexible structure 802 to a drink opening position $\mathbf{802}_D$, the vent structures 880 are also moved to an open position, as seen in FIGS. 35 and 36, to allow aroma vapors to escape the beverage container through the vent structures, as indicated by reference arrows 890.

Figure 33:
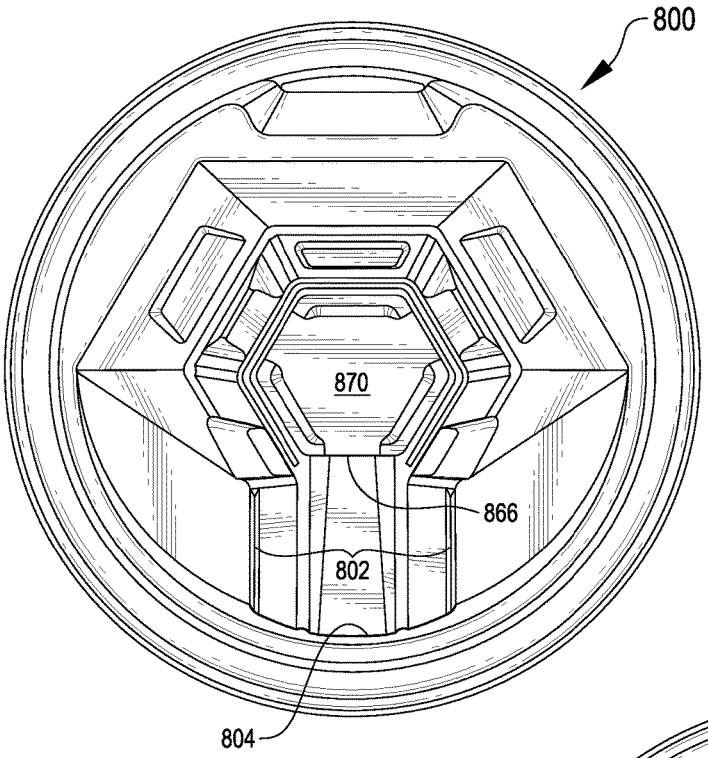
FIG. 33 is a top view of the embodiment of the beverage container lid just depicted in FIGS. 31 and 32 above.

FIG. 33 is a top view of the embodiment of the beverage container lid 800 just depicted in FIGS. 31 and 32 above.

Figure 34:
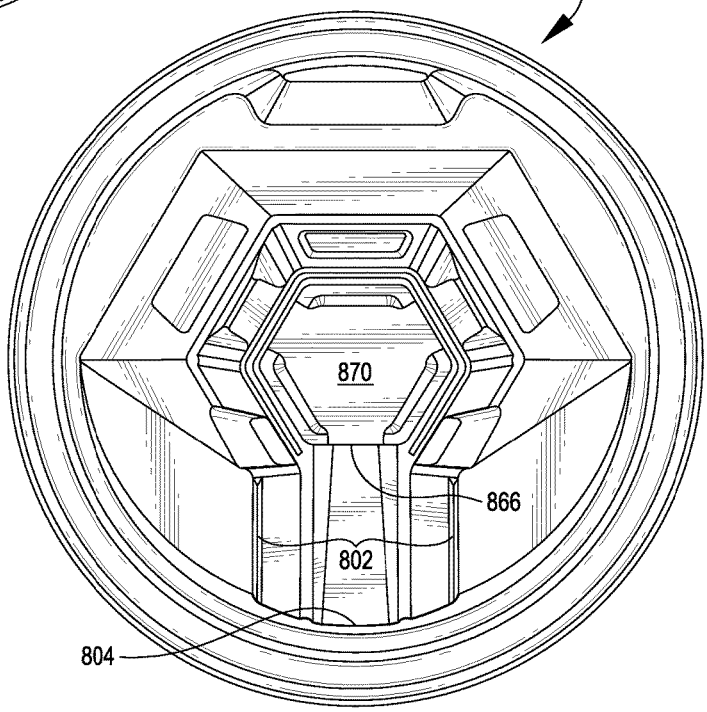
FIG. 34 is a bottom view of the embodiment of the beverage container lid just depicted in FIGS. 31, 32, and 33 above.

FIG. 34 is a bottom view of the embodiment of the beverage container lid 800 just depicted in FIGS. 31, 32, and 33 above.

FIG. 35 is a top perspective view, taken from the back, of the lid 800 just depicted in FIGS. 31-34 above, showing a drink-through lid for a beverage container which utilizes a flexible structure 802 extending from the interior portion 862 of the raised lip portion 854 of the drink-through lid 800 to an inward end, and wherein the inward end of the flexible structure is operatively coupled with an actuator, and wherein the actuator and flexible structure are depicted in a depressed, drink opening position, and where in the vent structures are open to allow vapors as indicated by reference arrows 890 to pass therethrough.

FIG. 36 is a top perspective view, taken from the back, of the lid 800 as just depicted in FIG. 35 above, showing a drink-through lid 800 for a beverage cup which utilizes a flexible structure 802 extending from the interior portion 862 of the raised lip portion 854 of the drink-through lid 800 to an inward end 866. The inward end 866 of the flexible structure 802 is operatively coupled with an actuator 870. As just noted above, the actuator 870 and flexible structure $\mathbf{802}_D$ are depicted in a depressed position, exposing drink opening 834. Also, the vent structures 880 are open to allow vapors, indicated by reference arrows 890, to pass therethrough.

Various embodiments may be provided using various types of plastics, such as thermoplastics. In various embodiments, the combination of a lid and beverage cup may be disposable, in that they are intended only for a single use. For such uses, very inexpensive thermoplastic materials may be suitable for construction of the lids 30, 200, 300, 400, 500, 600, 700, 800, or the like. Other than the exemplary structural techniques just mentioned above for facilitating manufacture of lid designs as taught herein, the processes for manufacturing such goods are well known in the art, and thus will not be further explained herein. However, those skilled in the art will recognize that various embodiments may be manufactured using other processes, and consequently, the invention is not limited to any particular method of manufacture.

In the foregoing description, for purposes of explanation, numerous details have been set forth in order to provide a thorough understanding of the disclosed exemplary embodiments for the design of a disposable lid with flexible structure for providing spill resistance, and for allowing the lid to be opened and closed, repeatedly during use. However, certain of the described details may not be required in order to provide useful embodiments, or to practice selected or other disclosed embodiments. Further, for descriptive purposes, various relative terms may be used. Terms that are relative only to a point of reference are not meant to be interpreted as absolute limitations, but are instead included in the foregoing description to facilitate understanding of the various aspects of the disclosed embodiments. And, various actions or activities in any method described herein may have been described as multiple discrete activities, in turn, in a manner that is most helpful in understanding the present invention. However, the order of description should not be construed as to imply that such activities are necessarily order dependent. In particular, certain operations may not necessarily need to be performed precisely in the order of presentation. And, in different embodiments of the invention, one or more activities may be performed simultaneously, or eliminated in part or in whole while other activities may be added. Also, the reader will note that the phrase "in an embodiment" or "in one embodiment" has been used repeatedly. This phrase generally does not refer to the same embodiment; however, it may. Finally, the terms "comprising", "having" and "including" should be considered synonymous, and open ended, and thus should be interpreted to mean "including, but not limited to", unless the context expressly dictates otherwise.

From the foregoing, it can be understood by persons skilled in the art that a novel beverage container lid, and flexible structure design to provide spill resistance while in use with a beverage container lid, have been described herein. Although only certain specific embodiments of the present invention have been shown and described, there is no intent to limit this invention by these embodiments. Rather, the invention is to be defined by the appended claims and their equivalents when taken in combination with the description.

Importantly, the aspects and embodiments described and claimed herein may be modified from those shown without materially departing from the novel teachings and advantages provided, and may be embodied in other specific forms without departing from the spirit or essential characteristics thereof. More generally, drink-through lid designs with various flexible structure designs, whether or not including a precisely trough shaped, or generally W-shaped, or curved flexible structure designs, may be configured using the teachings hereof, and are thus intended to be included with the breadth of appropriate claims as set forth below. Therefore, the embodiments presented herein are to be considered in all respects as illustrative and not restrictive or limiting. As such, this disclosure is intended to cover the structures described herein and not only structural equivalents thereof, but also equivalent structures.

Numerous modifications and variations are possible in light of the above teachings. Therefore, the protection afforded to this invention should be limited only by the claims set forth herein, and the legal equivalents thereof.

I claim:

1. A drink-through lid for a beverage cup having an open end, said drink-through lid comprising:

a base comprising a rim having a bottom edge, and an interior bead sealing portion, said base sized and shaped to sealingly engage the open end of the beverage cup;

a raised lip portion having an exterior portion extending upwardly from said base, an outer lip portion, and an interior portion sloping downwardly from said outer lip portion to lower end portions;

a drink well base having a floor extending inward from a peripheral side adjacent said lower end portions, the drink well base located downward from said outer lip portion;

a flexible structure, the flexible structure extending across said drink well base, from said interior portion of said raised lip portion to an inward end, said flexible structure comprising a stiffener, and at least a first panel, and at least a first base hinge, said first base hinge located between said floor of said drink well base and another component of the flexible structure, said flexible structure adjustably positionable between (1) an upwardly shaped flexible structure, and (2) a downwardly shaped flexible structure; and an outer slit between said flexible structure and said interior portion of said raised lip portion, whereby when said flexible structure is positioned in a downwardly shaped flexible structure, said outer slit defines a drink outlet between said interior portion and said flexible structure; and wherein said flexible structure further comprises a plurality of hinges which do not connect the flexible structure with the drink well base, and wherein said flexible structure comprises an elongated downwardly oriented generally W-shaped flexible structure.

2. A drink-through lid as set forth in claim 1, wherein said flexible structure comprises an interior end, and further comprising at least a first interior slit, said first interior slit located along at least a portion of said interior end of said flexible structure, so that when said flexible structure is positioned as a downwardly shaped flexible structure, said at least a first interior slit defines a vent opening at said interior end of said flexible structure.

3. A drink-through lid as set forth in claim 1, wherein said flexible structure comprises an outer end, and wherein said outer end is sized, shaped, and located to drain liquid from said drink well into said beverage cup when said flexible structure is positioned as a downwardly shaped flexible structure.

4. A drink-through lid as set forth in claim 1, wherein said flexible structure comprises at least a second base hinge, and at least a second panel, and wherein the second base hinge is located between said drink well base and said second panel.

5. A drink-through lid as set forth in claim 4, wherein said flexible structure comprises a stiffener and a plurality of panels, and wherein the-plurality of hinges includes at least a first base hinge located between said drink well base and said at least a first panel of said plurality of panels, and wherein at least a first top hinge of said plurality of hinges which do not connect the flexible structure with the drink well base is located between said at least a first panel and said stiffener.

6. A drink-through lid as set forth in claim 5, wherein said stiffener, the first base hinge, the second base hinge, the plurality of hinges which do not connect the flexible structure with the drink well base, and said plurality of panels are (a) sufficiently flexible so that said flexible structure is reversibly positionable between an upward, closed position, and a downward, open position wherein a drink outlet is provided in said interior portion of said raised lip portion, yet (b) sufficiently stiff so that said flexible structure remains positioned at either an upward closed position or in a downward open position.

7. A drink-through lid as set forth in claim 1, wherein said flexible structure and said drink well comprise integrally formed connected components.

8. A drink-through lid as set forth in claim 1, wherein said flexible structure and said drink well comprise integrally connected thermoformed components.

9. A drink-through lid as set forth in claim 1, wherein one or more of said plurality of hinges which do not connect the flexible structure with the drink well base comprises an elongated U-shaped hinge.

10. A drink-through lid as set forth in claim 1, wherein said flexible structure comprises a plurality of panels and a plurality of hinges which do not connect the flexible structure with the drink well base, said plurality of hinges including at least a first top hinge located between said at least a first panel and said stiffener, said plurality of panels comprising at least two panels that are sized and shaped to provide opposing force toward said plurality of hinges to thereby urge the flexible structure to maintain either an upward shape or a downward shape.

11. A drink-through lid as set forth in claim 1, wherein said lid further comprises an actuator and a first actuator hinge, said actuator operatively coupled with the flexible structure and with the first actuator hinge, wherein the actuator is configured to move the flexible structure to a downward, drink opening position in response to downward pressure on the actuator.

12. A drink-through lid as set forth in claim 11, wherein said flexible structure comprises a plurality of curved panels.

13. A drink-through lid as set forth in claim 1, wherein said lid further comprises an actuator and a first actuator hinge, said actuator operatively coupled with the flexible structure and with the first actuator hinge, wherein the actuator is configured to move the flexible structure to a downward, drink opening position in response to downward pressure on the actuator; and wherein said flexible structure comprises an interior end, and further comprising at least a first interior slit, said first interior slit located along at least a portion of said actuator, and wherein when said flexible structure is positioned in a downwardly shaped configuration, said first interior slit defines a vent opening in said flexible structure.

14. A drink-through lid as set forth in claim 13, further comprising a plurality of actuator panels and a plurality of actuator hinges, wherein some of the plurality of actuator hinges are located between the actuator and at least one of the actuator panels in the plurality of actuator panels.

15. A drink through lid as set forth in claim 14, wherein said at least one of the plurality of actuator panels comprises a lever, said lever manually operable to return said flexible structure to a convex, upward position from a concave, downward position.

16. A drink-through lid as set forth in claim 15, wherein one or more of said plurality of actuator panels comprises a trapezoidal shaped panel.

17. A drink-through lid as set forth in claim 13, further comprising a plurality of flat actuator panels.

18. A drink-through lid as set forth in claim 17, wherein one or more of said plurality of flat actuator panels comprises a rectangular shaped panel.

19. A drink-through lid as set forth in claim 13, further comprising a plurality of actuator panels and a plurality of actuator hinges, said plurality of actuator hinges including at least a first actuator hinge located between said drink well base and a first actuator panel, and a top actuator hinge located between a top actuator panel and the actuator, said plurality of actuator panels comprising at least two actuator panels that are sized and shaped to provide opposing force toward said plurality of hinges, so as to urge said flexible structure to maintain either a upward shape or a downward shape.

20. A drink-through lid as set forth in claim 1, wherein said flexible structure comprises a plurality of curved panels.

21. A drink-through lid as set forth in claim 1, wherein said flexible structure comprises a plurality of flat panels.

22. A drink-through lid as set forth in claim 21, wherein each one or more of said plurality of flat panels comprises a rectangular shaped panel.

23. A drink-through lid as set forth in claim 21, wherein one or more of the plurality of flat panels comprises a trapezoidal shaped panel.

24. A drink-through lid as set forth in claim 13, wherein said actuator comprises an outer face, the outer face operable to return the flexible structure to a convex, upward position when the flexible structure is in a concave, downward position.

25. A drink-through lid as set forth in claim 1, further comprising at least a first vent opening, said first vent opening spaced apart from said drink opening, so as to provide at least a first vent for outward movement of vapors from liquids in said cup.

26. A drink-through lid as set forth in claim 25, wherein said at least a first vent opening is provided by a slit in or adjacent said flexible structure.

27. A drink-through lid for a beverage cup having an open end, said drink-through lid comprising:

a base comprising a rim having a bottom edge, and an interior bead sealing portion, said base sized and shaped to sealingly engage the open end of the beverage cup;

a raised lip portion having an exterior portion extending upwardly from said base, an outer lip portion, and an interior portion sloping downwardly from said outer lip portion to lower end portions;

a drink well base having a floor extending inward from a peripheral side adjacent said lower end portions, the drink well base located downward from said outer lip portion;

a flexible structure extending inward across said drink well base from said interior portion of said raised lip portion to an inward end, said flexible structure comprising a stiffener, a plurality of hinges, and a plurality of panels;

said plurality of hinges comprising a first hinge between said drink well base and a first panel of said plurality of panels, and a second hinge between said drink well base and a second panel of said plurality of panels, a third hinge between said first panel and said stiffener, and a fourth hinge between said second panel and said stiffener;

an outer slit between said flexible structure and said interior portion of said raised lip portion, whereby when said flexible structure is positioned in a downwardly shaped flexible structure, said outer slit defines a drink outlet between said interior portion and said flexible structure; and wherein said flexible structure is adjustably positionable between an upwardly shaped flexible structure and a downwardly shaped flexible structure; and wherein the lid further comprises a central wall, and wherein said lid further comprises an actuator and an actuator hinge, said actuator hinge located between said central wall and said actuator, and said actuator hingedly connected to said flexible structure and adapted to adjustably position said flexible structure between an upwardly shaped flexible structure wherein said drink outlet is closed, and a downwardly shaped flexible structure wherein said drink outlet is open.

28. A drink-through lid for a beverage cup having an open end, said drink-through lid comprising:

a base comprising a rim having a bottom edge, and an interior bead sealing portion, said base sized and shaped to sealingly engage the open end of the beverage cup;

a raised lip portion having an exterior portion extending upwardly from said base, an outer lip portion, and an interior portion sloping downwardly from said outer lip portion to lower end portions;

a drink well base having a floor extending inward from a peripheral side adjacent said lower end portions, the drink well base located downward from said outer lip portion;

a flexible structure extending inward across said drink well base from said interior portion of said raised lip portion to an inward end, said flexible structure comprising a stiffener, a plurality of hinges, and a plurality of panels;

said plurality of hinges comprising a first hinge between said drink well base and a first panel of said plurality of panels, and a second hinge between said drink well base and a second panel of said plurality of panels, a third hinge between said first panel and said stiffener, and a fourth hinge between said second panel and said stiffener;

an outer slit between said flexible structure and said interior portion of said raised lip portion, whereby when said flexible structure is positioned in a downwardly shaped flexible structure, said outer slit defines a drink outlet between said interior portion and said flexible structure; and wherein said flexible structure is adjustably positionable between an upwardly shaped flexible structure and a downwardly shaped flexible structure; and further comprising one or more slits in or adjacent said flexible structure, or both, said one or more slits closed when said flexible structure is in an upwardly shaped flexible structure position, and when said flexible structure is moved to a downwardly shaped flexible structure wherein said drink outlet is open, said one or more slits define one or more vent openings in said lid.

* * * * *